US008584384B2

(12) United States Patent
Savenok

(10) Patent No.: US 8,584,384 B2
(45) Date of Patent: Nov. 19, 2013

(54) GARMENT PRESS ASSEMBLY, TRAVEL KIT, AND PRESSING METHODS

(76) Inventor: Pavel Savenok, Wheaton, IL (US)

( * ) Notice: Subject to any disclaimer, the term of this patent is extended or adjusted under 35 U.S.C. 154(b) by 56 days.

(21) Appl. No.: 12/931,753

(22) Filed: Feb. 9, 2011

(65) Prior Publication Data

US 2012/0198735 A1 Aug. 9, 2012

(51) Int. Cl.
*D06F 71/40* (2006.01)
*D06F 71/00* (2006.01)

(52) U.S. Cl.
USPC ..... 38/19; 38/36; 38/72

(58) Field of Classification Search
USPC ..... 38/69–72, 14, 17–24, 36
See application file for complete search history.

(56) References Cited

U.S. PATENT DOCUMENTS

| | | | | | |
|---|---|---|---|---|---|
| 724,198 | A | * | 3/1903 | Martin | 38/71 |
| 817,108 | A | * | 4/1906 | Fenner | 38/71 |
| 1,251,402 | A | * | 12/1917 | Miller et al. | 38/70 |
| 2,180,103 | A | | 11/1939 | Engbrecht et al. | |
| 2,612,257 | A | * | 9/1952 | Baur | 206/292 |
| 2,612,258 | A | * | 9/1952 | Baur | 206/292 |
| 3,068,598 | A | * | 12/1962 | Johnston | 38/71 |
| 3,084,462 | A | | 4/1963 | Purpura | |
| 3,290,807 | A | * | 12/1966 | Esaka | 38/71 |
| 3,593,440 | A | | 7/1971 | Schlemon | |
| 3,665,624 | A | * | 5/1972 | Briddell | 38/71 |
| 3,722,115 | A | | 3/1973 | Hanson | |
| 3,765,580 | A | | 10/1973 | Wilsker et al. | |
| 3,823,854 | A | | 7/1974 | Everett | |
| 3,877,161 | A | | 4/1975 | Engelbart | |
| 4,342,409 | A | | 8/1982 | Brollos | |
| 4,910,894 | A | | 3/1990 | Vartan | |
| 4,998,360 | A | | 3/1991 | Lee | |
| 5,075,931 | A | | 12/1991 | Van Kuijk | |
| 5,359,792 | A | | 11/1994 | Hanada et al. | |
| 7,210,254 | B2 | | 5/2007 | Docker | |
| 7,409,786 | B2 | | 8/2008 | Lee | |

* cited by examiner

*Primary Examiner* — Ismael Izaguirre
(74) *Attorney, Agent, or Firm* — Meroni & Meroni, P.C.; Charles F. Meroni, Jr.; Christopher J. Scott

(57) ABSTRACT

A mechanical garment press assembly enables users to mechanically press garments during travel and may be stored or carried in combination with standard carry-on luggage. The garment press assembly comprises opposed outer resilient planar members, each of which has a hinge end and a clamp end. A hinge member flexibly interconnects the hinge ends. Clamping structure clamps the clamp ends toward one another after a (wrinkled) garment section is received intermediate the opposed outer planar members for imparting primary wrinkle-removing forces into the target garment section. Tension members interconnect the hinge ends to the clamp ends and retain the resilient members is bowed tension for imparting secondary wrinkle-removing forces into the target garment section. Various portable assemblies are contemplated based on the foregoing basics as well as a home-based version. Certain garment pressing methods are also described based on the foregoing basics.

31 Claims, 17 Drawing Sheets

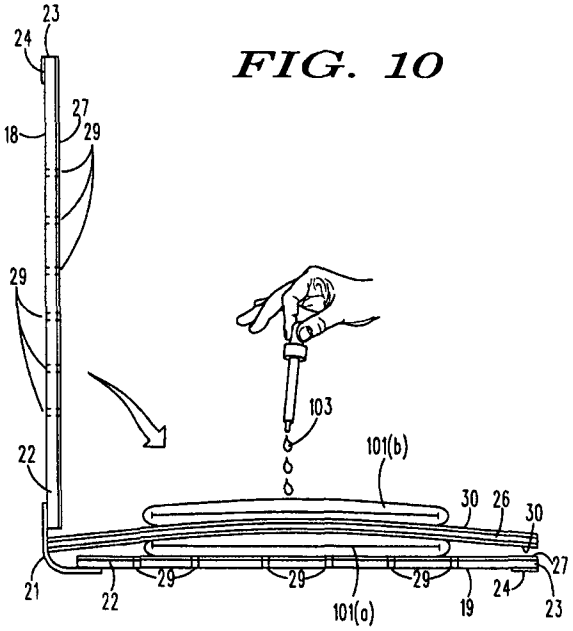
FIG. 10
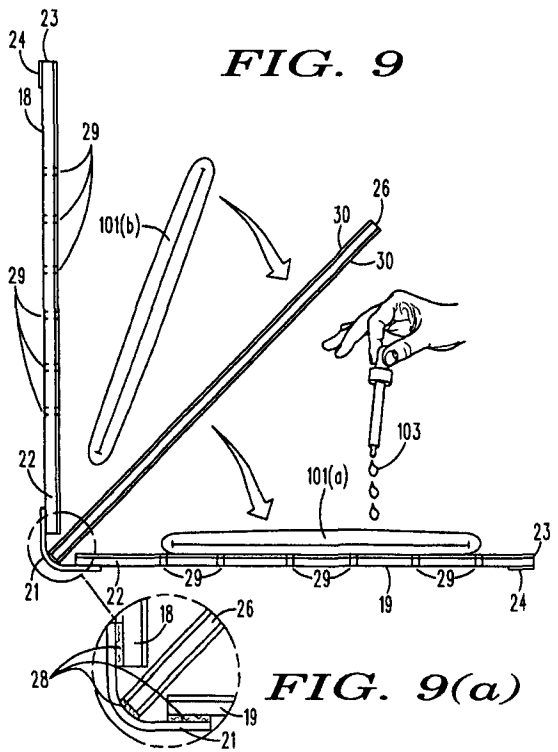
FIG. 9
FIG. 9(a)

GARMENT PRESS ASSEMBLY, TRAVEL KIT, AND PRESSING METHODS

BACKGROUND OF THE INVENTION

1. Field of the Invention

The present invention relates generally to a portable garment press assembly. More particularly, the present invention relates to a mechanical, non-electrical garment press assembly for enabling travelers to mechanically remove wrinkles from garment sections, which garment press assembly is designed to fit within standardized carry-on luggage, and has certain garment pressing methodology associated therewith.

2. Brief Description of the Prior Art

The field of garment pressing arrangements and the like is fairly well-developed. Some of the more pertinent prior art is briefly described hereinafter. For example, U.S. Pat. No. 4,998,360 ('360 patent), which issued to Lee, discloses a Portable Ironing Press including Chain, Gear, and Spring Arrangement for Pressing Articles. The '360 patent describes a portable ironing press that uses a compression spring to generate pressure between two pivotable plates for smoothing out a garment. The press includes a chain-and-gear arrangement to selectively apply the pressure of the spring to the plates. It is noted that the subject invention does not include spring resistance in its methodology as compared to that taught by the '360 patent.

U.S. Pat. No. 5,075,931 ('931 patent), which issued to van Kuijk, discloses a Portable Unit with Universal Clip. The '931 patent describes a portable unit, comprising a housing, a clip piece fixed to the housing by a hinge, and spring means which press the clip piece against the housing for forming a clip which is suitable for being clipped over an edge of a garment. The clip piece has an essentially L-shaped part with the hinge being fitted at a distance from one leg of the L-shaped part. The axis of the hinge runs essentially parallel to said one leg of the L-shaped part and such that the one leg extends past the hinge in the longitudinal direction of said one leg. It is again noted that the subject invention does not include spring resistance in its methodology as compared to that taught by the '931 patent.

U.S. Pat. No. 5,359,792 ('792 patent), which issued to Hanada et al., discloses a Free Standing, Upright Clothes Press. The '792 patent describes a vertical-type clothes press, in which clothes such as pants or the like held between a fixed board and a movable board can be pressed for smoothing or creasing, includes a mount base, a fixed board vertically mounted thereon and having a heater, a movable board having a hollow structure for hot-pressing clothes held between itself and the fixed board, a hinge mechanism which rotatably connects the lower ends of the fixed board and the movable board and mounts the movable board openably and closably on the fixed board opposite to each other, a lock mechanism for holding the movable board against the fixed board, a press sheet having one end attached to the connection between the fixed board and the movable board and rotatably provided between the movable board and the fixed board, reinforcements provided along the side end faces of the press sheet in a vertical direction, and a bias device provided on the opposite side of the hinge mechanism for pulling clothes or the like held between the fixed board and the movable board in a direction away from the hinge mechanism.

A shift of the centroid becomes small when the movable board is open. Thus, the fixed board can be stably installed in a vertical direction, and a shift in position for the clothes to be pressed is prevented. Further, an operation for putting the clothes in order becomes easy and the clothes are equally smoothed and pressed. It is noted that the subject invention does include a lock mechanism for holding opposed boards together much in the same manner as your boards are locked together. This patent thus presents a certain obstacle which you will have to overcome in order to gain the allowance of patent claims.

U.S. Pat. No. 7,210,254 ('254 patent), which issued to Docker, discloses a Trouser Press/Ironing Board. The '254 patent describes a combined trouser press and ironing board assembly. It comprises a heatable pad against which a surface of a pressure plate is clampable in a first position to sandwich a garment to be pressed therebetween. The pressure plate is mounted by means which allow said plate to be moved relative to the heatable pad into a second ironing position in which the pressure plate extends laterally outwardly relative to the heatable pad so that the surface thereof which was facing the heatable pad in its first position now provides the surface on which a garment can be placed for ironing.

U.S. Pat. No. 7,409,786 ('786 patent), which issued to Lee, describes a Handheld Pressing Pad and Method of Removing Wrinkles. The '786 patent describes a method of removing wrinkles, and a device to assist in wrinkle removal. In this regard, it will be seen from a review of the '786 patent that wrinkles are removed from items such as clothing, linens, curtains, upholstery, fabrics and the like by placing a handheld pad on one side of the item, a wrinkle-removing device (such as a nozzle of a garment steamer) on the other side of the item, and pressing a portion of the item between the pad and the wrinkle-removing device.

The wrinkle-removing device and the pad are moved about the item compressing a small portion of the item at a time until the wrinkles are removed from the entire item. The pad device of the instant invention includes a working surface against which a portion of the item is pressed by the wrinkle removing device, and a handgrip for the user to support the pad on a user's hand. The pad includes a foam core that insulates the user's hand from heat of the wrinkle-removing device. The foam core is located within a heat-reflective pouch to further insulate the user's hand and to aid in wrinkle removal.

From a consideration of the foregoing, it will be noted that the prior art perceives a need for a portable garment press assembly usable in combination with standardized carry-on luggage assemblies comprising resilient outer planar members for sandwiching target garment sections and together may be bowed and retained in tension via certain tensioning means doubly useful to clamp ends of the outer planar members toward one another. In this last regard, the prior art perceives a need for such a portable garment press assembly, luggage combination, and pressing methodology as summarized in more detail hereinafter.

SUMMARY OF THE INVENTION

To achieve these and other readily apparent objectives, the present invention essentially discloses a portable garment press assembly as at (10(*a*), 10(*b*), 11, 12, and 13), a luggage travel kit or combination (comprising luggage assembly 14), and certain garment pressing methods associated therewith for enabling travelers to mechanically press garments or garment sections. It is believed that the portable garment press assembly according to the present invention essentially comprises first and second outer planar members, each of which has a hinge end and a clamp end.

The portable garment press assembly preferably comprises a first flexible hinge structure or member flexibly attached at the hinge ends of the outer planar members for interconnecting the hinge ends; and certain clamping means for clamping the clamp ends of the outer planar members toward one another. The clamping means may preferably comprise a member-attached section and a flexible clamp or clamping material section. The member-attached section and the flexible clamp together clamp the clamp ends of the outer planar members toward one another.

A garment section may be received intermediate (1) the first and second outer planar members and (2) the first flexible hinge and clamping means. The first and second outer planar members function to impart garment-compressive and/or wrinkle-removing forces into a received garment section when the clamping means clamp the clamp ends toward one another.

The portable garment press assembly may optionally comprise an inner planar member sandwiched intermediate the first and second outer planar members and preferably attached to the first flexible hinge member. It is contemplated that the inner planar member may well function to separate opposed garment sections as received intermediate the first and second outer planar members. The inner planar member may preferably comprise opposed hydrophobic or polymeric padded surfacing as at 30 for resisting moisture absorption by the inner planar member.

In contradistinction thereto, the first and second outer planar members may each preferably comprise inner hydrophilic, moisture absorptive, or moisture wicking surfacing for enhancing moisture absorption from garment sections coming into contact therewith, provided the user/traveler opts to moisture the garment sections before pressing the garment sections with the portable press assembly according to the present invention. Further, a select outer planar member (with hydrophilic surfacing) may optionally comprise at least one, but perhaps a series of apertures extending orthogonally relative to the plane of the select outer planar member enabling moisture to pass therethrough.

A central feature to the practice of the present invention is the outer (and inner) planar members are preferably constructed from a semi-rigid resilient (bendable) material. When used in combination with certain tensioning means as exemplified throughout the specifications, said tensioning means may well function to interconnect the hinge ends to the clamp ends. Thus interconnected, the outer planar members may be resiliently and arcuately bowed via the tensioning means and retainable in bowed tension for imparting wrinkle-removing forces to received garment section(s).

The first flexible hinge structure or member may preferably comprise outer hinge surfacing and the member-attached section may preferably comprise outer clamp surfacing. It will thus be understood that the outer hinge and clamp surfacing comprises certain first fastening means. The tensioning means may well preferably comprise certain second fastening means such that the first and second fastening means are cooperable for fastening the tensioning means to the first flexible hinge and member-attached section for retaining the outer planar members in bowed tension.

It is contemplated that the tensioning means are length-adjustable for enabling the user to vary the garment-compressive and/or wrinkle-removing forces. When the tensioning means are exemplified by looped members or straps (as at 35) it is contemplated that the tensioning means may be looped around the hinge ends and clamp ends for interconnecting the hinge ends to the clamp ends, and that the looped tensioning means are loop-adjustable (e.g. via a buckle mechanism as at 36) for enabling the user to vary the garment-compressive and/or wrinkle-removing forces.

The portable garment press assembly may comprise substantially identically paired first and second outer planar members with first flexible hinge structures or members and certain clamping means for joining the same. The paired first outer planar members (or second outer planar members) are foldable about the second flexible hinge member (e.g. along fold axis 39) for collapsing the portable garment assembly, which then may be inserted into a luggage assembly.

In other words, the portable garment press assembly 13 may comprises two assemblies 11 (or two assemblies 10(*a*) or 10(*b*), but are joined together (via a select set of outer planar members (e.g. the first outer planar members or the second outer planar members) by a second (or third) flexible hinge structure or member (as at 38) at a paired-member junction (as at junction edges 37) intermediate the paired first and second outer planar members.

In addition to the foregoing structural considerations, it is further believed that the inventive concepts discussed support certain new methodologies and/or processes. In this regard, it is contemplated that the foregoing structure considerations support a method for mechanically pressing a garment section comprising the steps of initially providing a portable garment press assembly comprising opposed resilient outer planar members interconnected at hinge ends thereof by a hinge structure.

A garment section may thus be positioned upon a first of the opposed outer planar members, and a second of the opposed outer planar members may be positioned into contact with the garment section via the hinge structure. Notably, moisture may be added to the garment section before positioning the second outer planar member into contact with the garment section.

The opposed outer planar members may then be clamped toward one another at clamp ends thereof for imparting primary garment-compressive, wrinkle-removing forces into the received garment section. The hinge ends may be interconnected to the clamp ends with certain tensioning means for resiliently and arcuately bowing the outer planar members for imparting secondary garment-compressive and/or wrinkle-removing forces into the garment section.

In view of the fact that the portable garment press assembly may comprise an inner planar member, the method for mechanically pressing a garment section may further comprise the step of separating opposed garment sections via the inner planar member as received intermediate the opposed outer planar members. Further, as has been noted, the hinge structure may preferably comprise certain outer hinge surfacing and the clamping means may comprise certain outer clamp surfacing.

Together the outer hinge and clamp surfacing thus define certain first fastening means matable with second fastening means outfitted upon the tensioning means. The first and second fastening means are thus cooperable for fastening the tensioning means to the hinge structure and clamping means for retaining the outer planar members in bowed tension.

The user or traveler may selectively vary the garment-compressive and/or wrinkle-removing forces by bowing the outer planar members in a select direction as selected from two possible directions (i.e. toward the first outer planar member or toward the second outer planar member). It will be recalled that the outer planar members may comprise varied relative thickness, which varied relative thickness is believed to enable the user to selectively vary the wrinkle-removing forces. Additionally, the tension in the tensioning means may be adjusted for varying the garment-compressive and/or wrinkle-removing forces.

BRIEF DESCRIPTION OF THE DRAWINGS

Other features of my invention will become more evident from a consideration of the following brief descriptions of patent drawings:

FIG. 9 is a first sequential diagrammatic edge view type depiction of first and second garment sections positioned intermediate outer and inner planar members before the ensemble is placed into pressed relation.

FIG. 9(*a*) is a fragmentary enlarged sectional view as sectioned from FIG. 9 showing hinge structure attachment points in greater detail.

FIG. 10 is a second sequential diagrammatic edge view type depiction of first and second garment sections positioned intermediate outer and inner planar members before the second outer planar member is positioned into pressing relation.

FIG. 11(*a*) is a fragmentary enlarged sectional view as sectioned from FIG. 11. showing multiple layers of materials in greater detail.

FIG. 18(*a*) is a fragmentary enlarged sectional view as sectioned from FIG. 18 showing the ends of first and second outer planar members (with attached hydrophilic surfacing) and an inner planar member, the inner planar member, first outer planar member and second outer planar member having varied thicknesses.

FIG. 18(*b*) is a fragmentary enlarged view akin to FIG. 18(*a*) showing the ends of first and second outer planar members (with attached hydrophilic surfacing) and an inner planar member, the first outer planar member and second outer planar member having similar thicknesses.

DETAILED DESCRIPTION OF THE PREFERRED EMBODIMENTS AND METHODOLOGY

Figure 1:
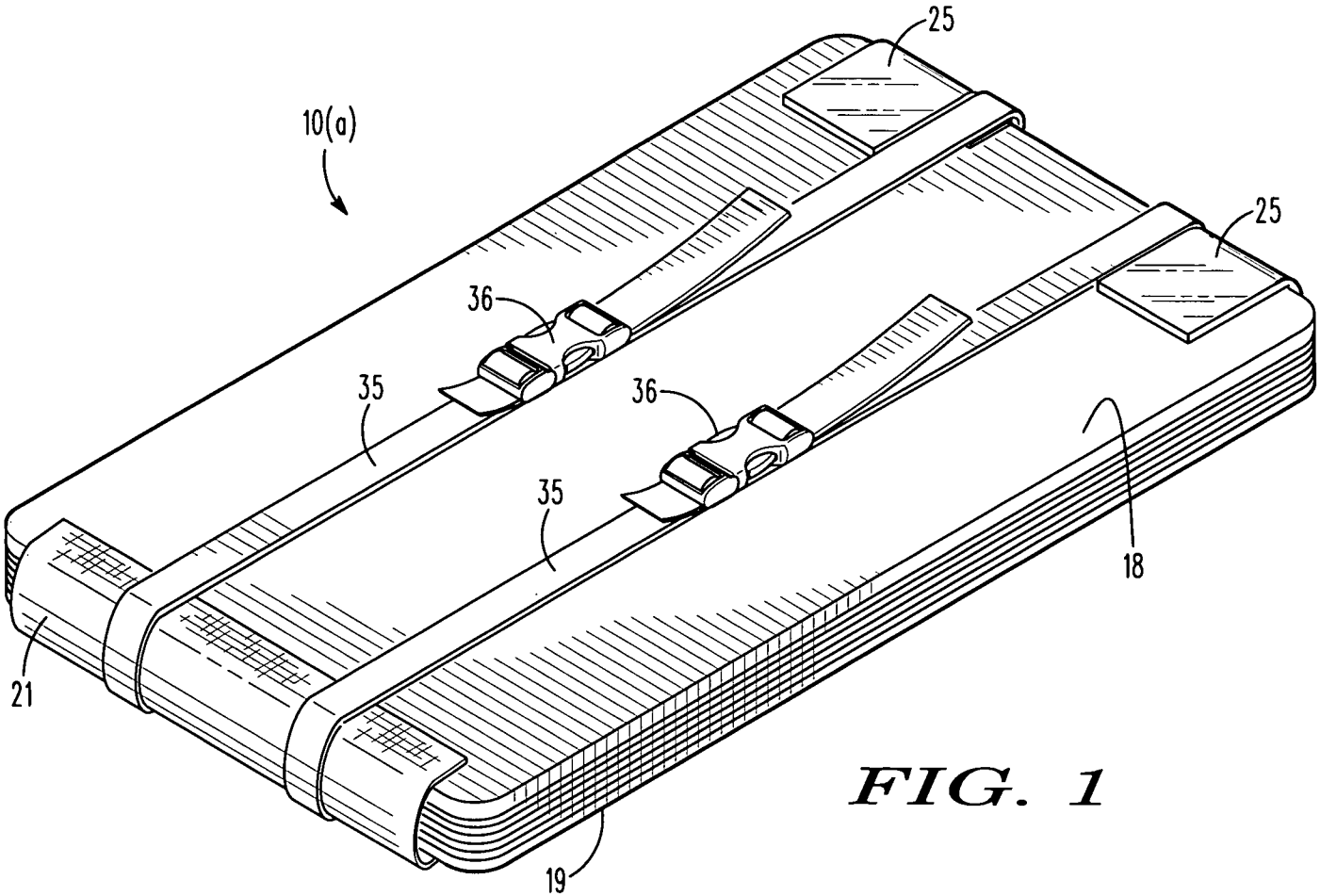
FIG. 1 is a top perspective view of a first alternative embodiment of the portable garment press assembly according to the present invention showing looped straps, a hinge member and flexible clamping structures (the looped straps being looped adjacent the flexible clamping structures) for holding a series of substantially planar members in stacked relation.

Referring now to the drawings with more specificity, the preferred embodiments of the present invention concern certain travel type garment press assemblies; a travel kit comprising both a standardized piece of carry-on luggage and several of the garment press assemblies in combination therewith; a home version of a garment press assembly; and various associated garment pressing methods reflective of the underlying essential simplified, mechanical garment press assembly of which, as noted, there are several contemplated embodiments.

It is believed that three of the four garment press assemblies illustrated in this application are designed to accompany and/or accommodate standardized carry-on luggage, while a fourth embodiment contemplates a relatively convenient, portable, home-version of a mechanical garment press assembly. The various garment press assemblies are thus listed and referenced in descending order of preference, as follows assemblies 10(*a*) and 10(*b*); assembly 11, assembly 12, and assembly 13.

Assemblies 10(*a*), 10(*b*), 11, and 12 are contemplated to enable users or travelers to mechanically press garments during travel. It is noted that oftentimes during travel, the traveler does not have access to, or is forbidden from utilizing an electrical garment-pressing iron or similar such device. The general design of assemblies 10(*a*), 10(*b*), 11, and 12 is thus contemplated to enable a traveler to conveniently pack one of the assemblies so that the traveler's garments may nevertheless be pressed should other pressing means be unavailable to the traveler.

Figures 22, 23:
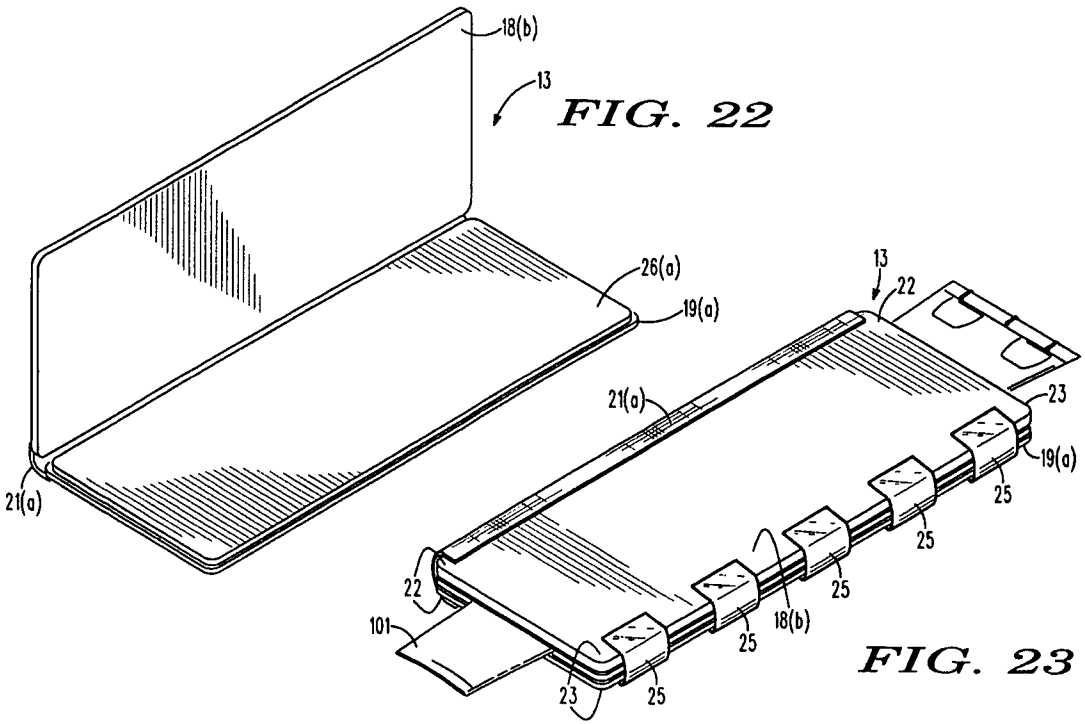
FIG. 22 is a top perspective view of a fifth alternative embodiment of the portable garment press assembly according to the present invention showing a relatively elongate garment press assembly contemplated for home use showing a relatively elongate first hinge structure; relatively elongate first and second outer planar members; and a relatively elongate inner planer member with the first outer planar member extending in a plane substantially orthogonal to the plane of the second and inner planar members.
FIG. 23 is a top perspective view of the fifth alternative embodiment of the portable garment press assembly according to the present invention showing a trouser garment section being pressed thereby with a series of flexible clamping structures clamping the clamp ends of the first and second outer planar members.
Figure 24:
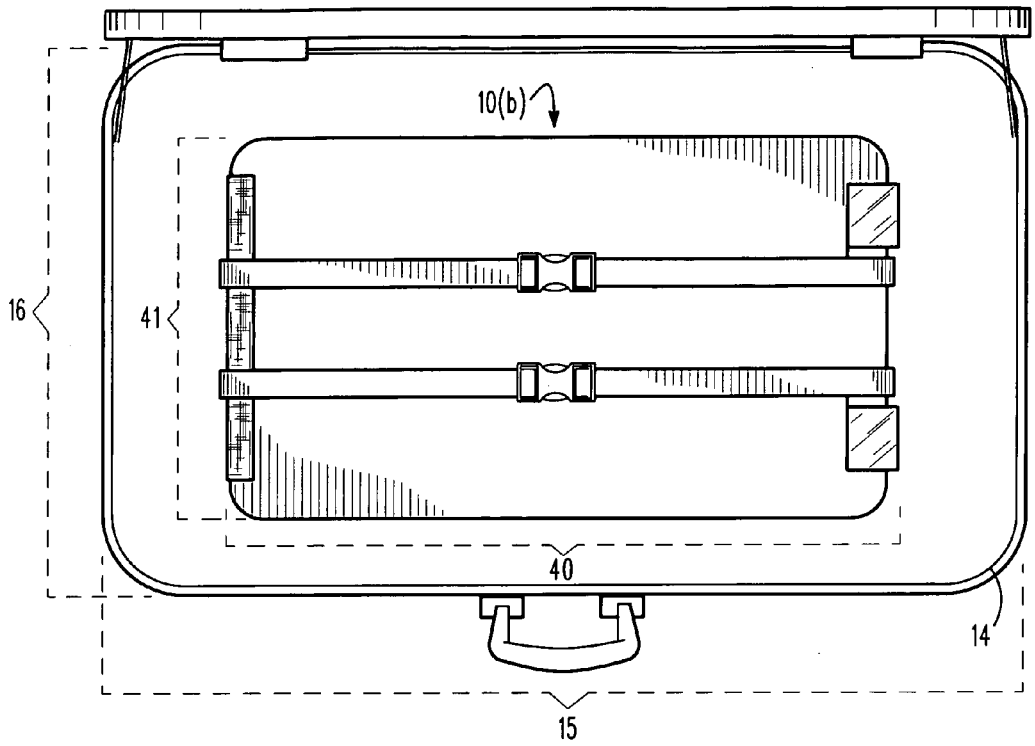
FIG. 24 is a top plan view of an open luggage assembly with the first alternative embodiment of the portable garment press assembly according to the present invention as received within the luggage assembly.
Figure 25:
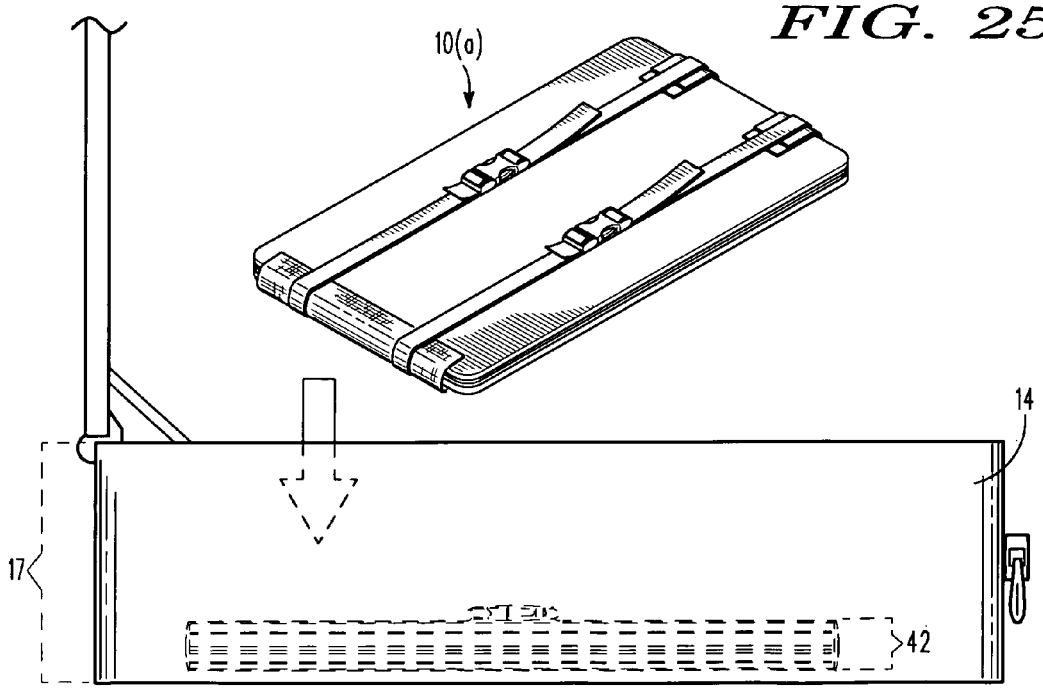
FIG. 25 is a top perspective view of the second alternative embodiment of the portable garment press assembly according to the present invention being placed into a fragmentary luggage assembly (shown from the side), which luggage assembly shows a phantomly placed portable garment press assembly.

Assemblies 10(*a*), 10(*b*), 11, and 12 as variously depicted and referenced may thus be viewed as together being representative of the type of embodiment that may be viewed in combination with a standardized carry-on luggage assembly 14 a generally depicted and referenced in FIGS. 23 and 24. It will be seen from an inspection of the various figures that luggage assembly 14 is constructed so as to have three dimensions, namely a length as at 15, a width as at 16, and a depth as at 17, which according to most common luggage carry on standards are 21 inches (or 53.34 centimeters) in length; 14 inches (or 35.56 centimeters) in width; and 7 inches (or 17.78 centimeters) in depth, respectively.

The portable garment press assemblies 10(*a*), 10(*b*), 11, and 12 are thus each designed so as to be sized and shaped for receipt within the luggage length 15, luggage width 16, and luggage depth 17 as generally depicted in FIGS. 23 and 24. Defining the major length and width portions of the assembly, it will be seen that each of the portable or travel garment press assemblies 10(*a*), 10(*b*), 11, and 12 preferably comprises a first outer substantially planar member as at 18 and a second outer substantially planar member as at 19.

The first and second outer substantially planar members 18 and 19 are preferably and generally rectangular in shape having rounded corners as at 20, and are preferably constructed form semi-rigid, resilient material(s) such as heavy gauge card stock, paperboard, polymeric sheeting, etc. The length 40 and width 41 dimensions of the sheets or outer planar members 18 and 19 are believed preferably formed so as to be less than 21 inches in length; and less than 14 inches in width for proper and cooperable receipt within the luggage assembly 14.

The preferred thickness(es) of the first and second outer substantially planar members 18 and 19 provide best results when formed from paperboard type material(s) having between 0.06 inches (0.16 centimeters) and 0.13 inches (or 0.32 centimeters). Other materials may have alternative thicknesses depending on the force dynamics sought by the end user or manufacturer for pressing garments or garment sections as received therebetween. The maximum depth or thickness (as at 42) of the assemblies 10(*a*), 10(*b*), 11, and 12 should be no greater than depth 17 of luggage assembly 14.

Figure 5:
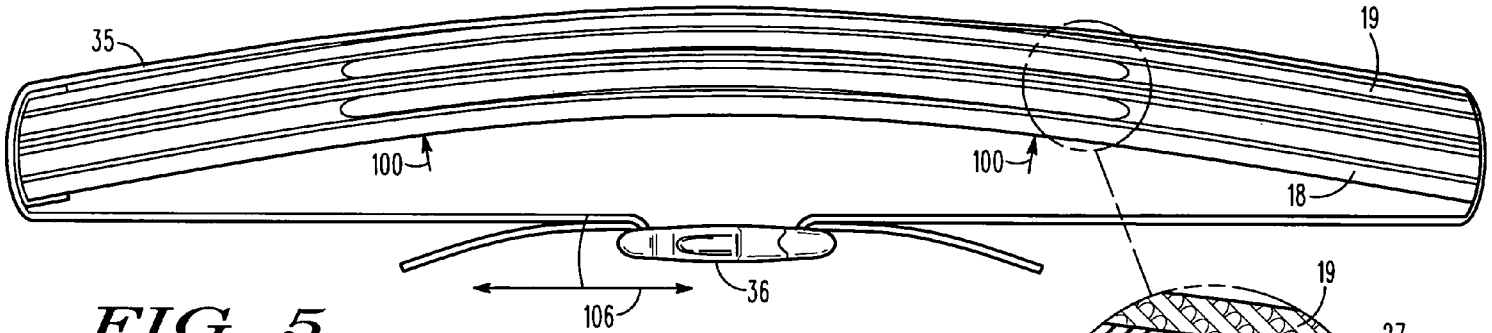
FIG. 5 is a side elevational view of the second alternative embodiment of the portable garment press assembly according to the present invention (with clamping structures removed) showing first and second garment sections received or sandwiched intermediate a series of planar members with a looped strap retaining the substantially planar members and pressed garment sections in stacked, arcuately bowed relation.
Figure 6:
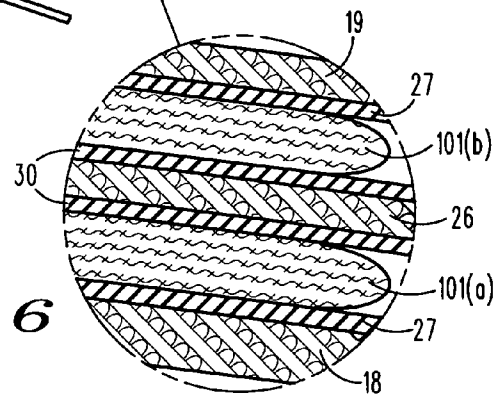
FIG. 6 is a fragmentary enlarged section view as sectioned from FIG. 5 showing first and second garment sections received or sandwiched intermediate a series of substantially planar members in stacked, arcuately bowed relation.
Figure 16:
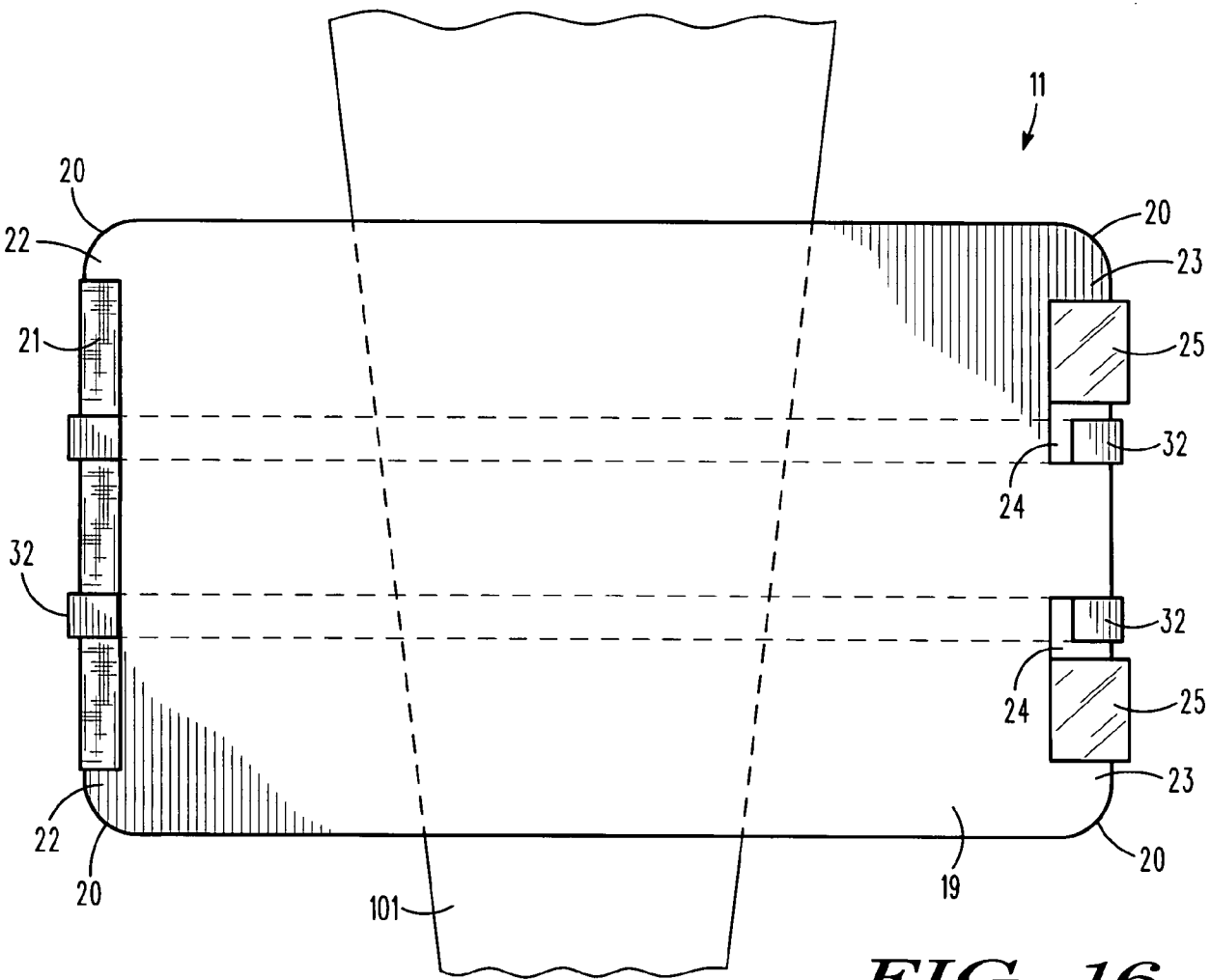
FIG. 16 is a top plan view of the third alternative embodiment of the portable garment press assembly showing a fragmentary trouser section received via the third alternative embodiment.

In this last regard, it should be noted that somewhat central to the practice of the present invention is that the outer substantially planar members 18 and 19 may be preferably arcuately bent lengthwise as generally depicted in FIGS. 5 and 16 so as to selectively impart secondary garment-compressing and/or wrinkle-removing forces as at 100 into pressed target garment sections(s) as generically depicted by trousers at 101 (and 101(*a*)/101(*b*)). In addition to the secondary garment-compressing and/or wrinkle-removing forces 100, certain primary garment-compressing, wrinkle-removing forces 102 are also directed into the pressed target garment section(s) 101, the latter of which perhaps warrant first explanation.

Primary garment-compressing, wrinkle-removing forces as at 102 are directed into the pressed target garment sections (s) 101 by sandwiching the garment section(s) 101 intermediate the first and second outer substantially planar members 18 and 19. In this regard, it should be noted that a first target garment portion or garment section 101(*a*) is placed atop inner surfacing of a first outer substantially planar member 18 as generally depicted in FIG. 9.

Moisture 103 may be selectively added to the placed or positioned garment section(s) 101(*a*) or 101(*b*) as generically depicted in FIGS. 9 and 10. The second outer substantially planar member 19 may then sandwich or press the received garment section 101(*a*) toward the first outer substantially planar member 18 so as to direct preliminary garment-compressing, wrinkle-removing forces into the received garment section 101(*a*).

Notably, with regard to the added optional step of applying moisture as generically depicted and referenced at 103, it should be further noted that the inner surfacing of the first and second outer planar members 18 and 19 may preferably each comprise inner hydrophilic, moisture-wicking, or moisture-absorbent surfacing as at 27. The hydrophilic or moisture-absorbent surfacing 27 functions to effectively enhance moisture absorption from garment sections 101 coming into contact therewith.

The surfacing 27 may preferably be formed from a moisture-absorbent layer or similar material permanently (e.g. adhesively) attached to the inner surfacing of the first and second outer planar members 18 and 19. Adhesive layers are depicted at 28 throughout the drawings, and particularly in enlarged fragmentary sectional FIGS. 9(*a*) and 10(*a*). Optional apertures 29 may also be formed orthogonally to the plane of the members 18 and 19 (and surfacing 27) so as to allow moisture 103 to further escape from the ensemble.

The pressing action between the first and second outer substantially planar members 18 and 19 is believed effectively and preferably achieved by incorporating a flexible hinge member as at 21, which member 21 is permanently (e.g. adhesively) attached to the hinge ends 22 of the first and second outer substantially planar members 18 and 19. Certain clamping means are also outfitted or otherwise associated with clamp ends 23 (opposite the hinge ends 22) so as to clamp or compress the clamp ends 23 toward one another, while similarly imparting compressive forces 102 into the pressed target garment sections 101 via the outer substantially planar members 18 and 19.

Figure 12:
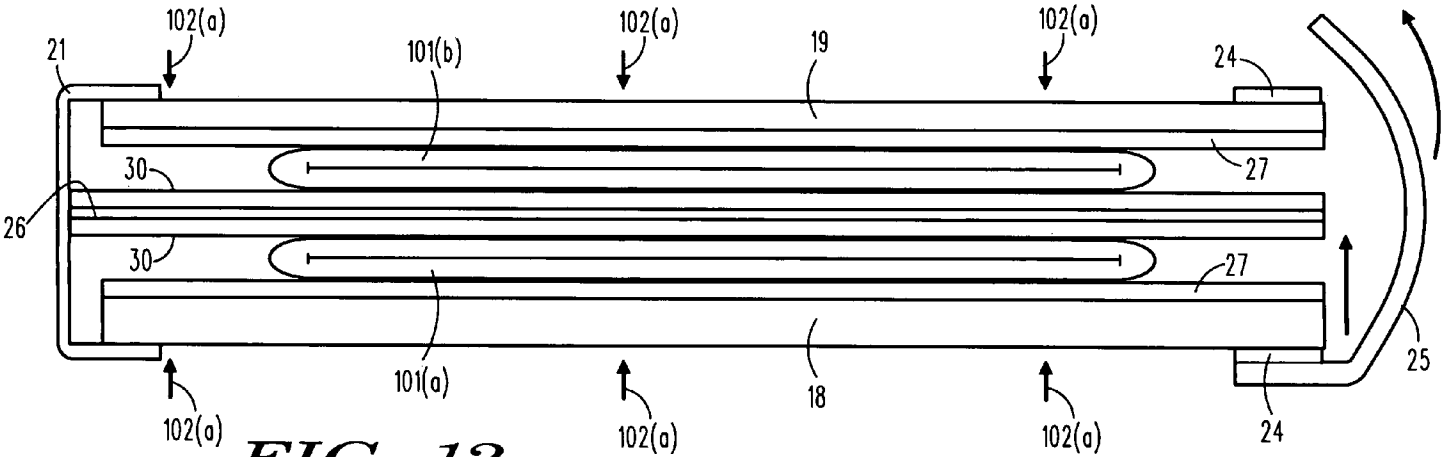
FIG. 12 is an enlarged third sequential diagrammatic edge view type depiction of first and second garment sections positioned intermediate outer and inner planar members before a flexible clamping member is fastened to an upper member-attached section for rendering the arrangements into primary pressed relation.
Figure 13:
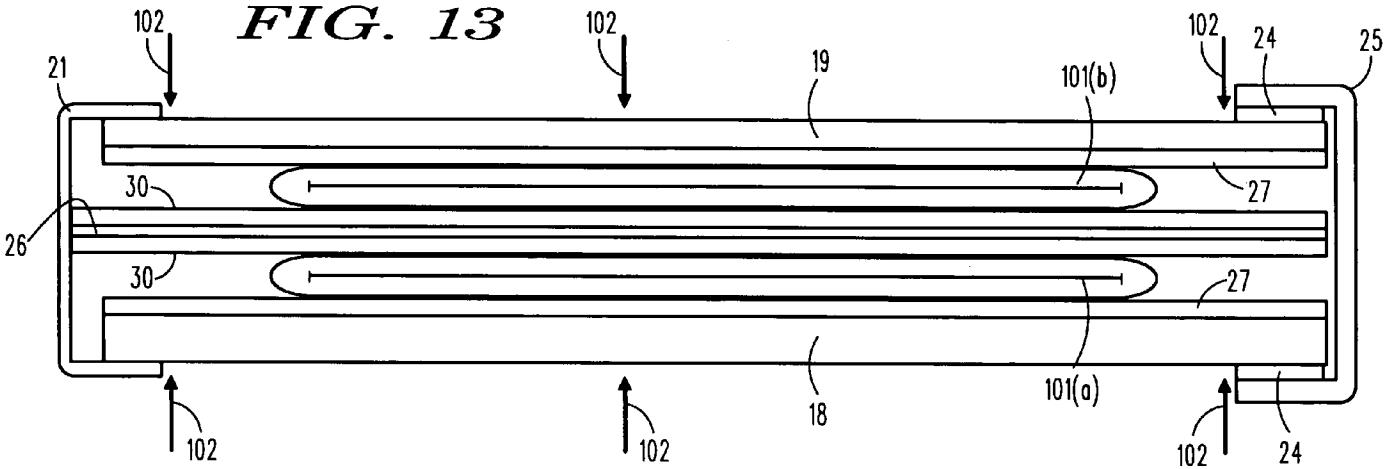
FIG. 13 is an enlarged fourth sequential diagrammatic edge view type depiction of first and second garment sections positioned intermediate outer and inner planar members after the flexible clamping member is fastened to the upper member-attached section for rendering the arrangements into primary pressed relation.
Figure 14:
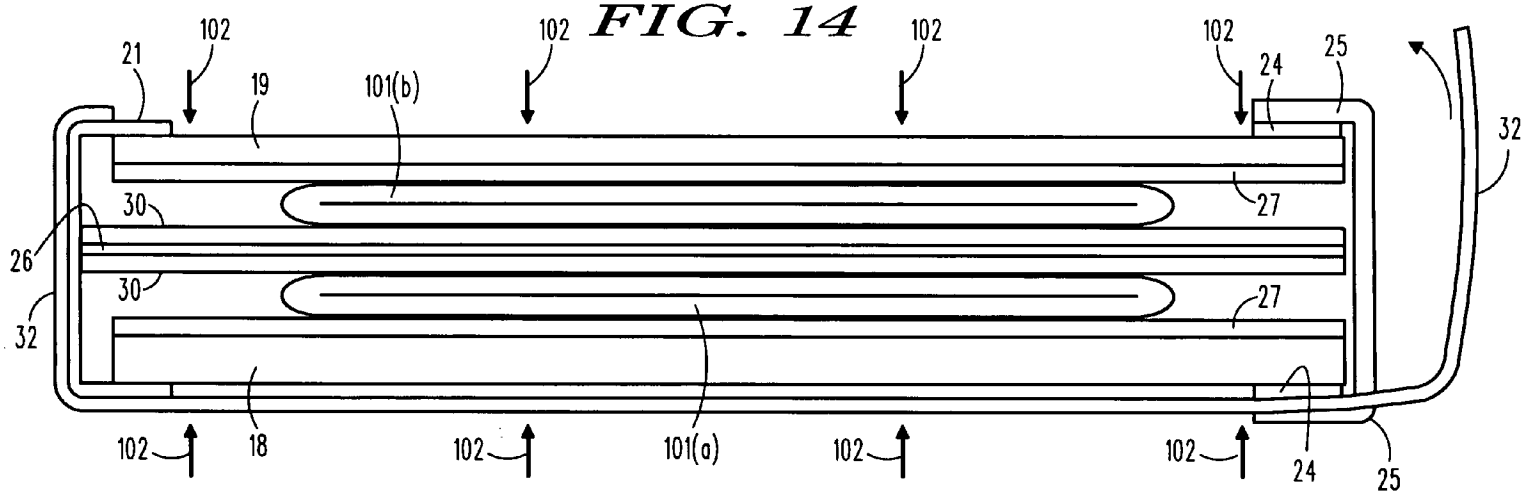
FIG. 14 is an enlarged fifth sequential diagrammatic edge view type depiction of first and second garment sections positioned intermediate outer and inner planar members before a tension strap is fastened to an upper member-attached section for rendering the arrangements into secondary pressed relation.
Figure 15:
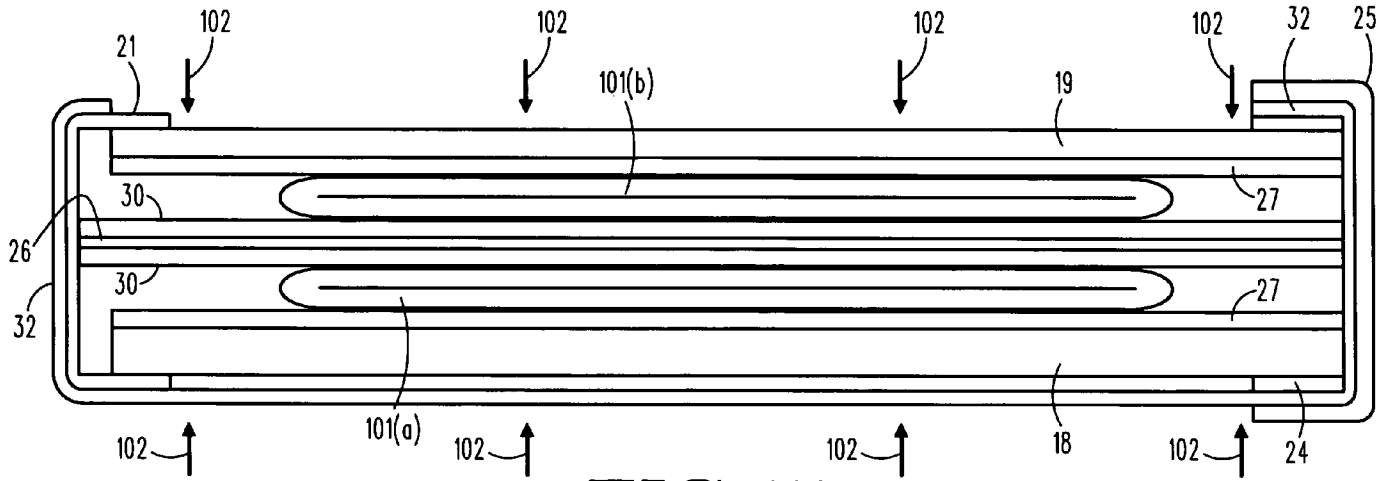
FIG. 15 is an enlarged fourth sequential diagrammatic edge view type depiction of first and second garment sections positioned intermediate outer and inner planar members after the tension strap is fastened to the upper member-attached section for rendering the arrangements into secondary pressed relation.

Notably, the weight of the second outer substantially planar member 19 and the materials received atop first outer substantially planar member 18 direct certain relative smaller magnitude preliminary compressive forces 102(*a*) into the received garment sections 101 (or 101(*a*) and 101(*b*)) as comparatively depicted in FIGS. 12 and 13.

The clamping/compressing action of the clamping means (it being noted that there is offsetting tension in the flexible hinge member 21) direct compressive forces into the pressed target garment section 101 via the members 18 and 19 for effectively removing wrinkles otherwise present in the garment section 101. It is contemplated that the ensemble may be left unattended for a select period of time (e.g. overnight) when so clamped, and when the select time period has elapsed, the pressed target garment section 101 may be released from the portable garment press assembly and shown to have improved garment surfacing with garment-detracting wrinkles entirely or nearly entirely removed therefrom.

The clamping means are believed best exemplified by flexible structures such as hook and loop (e.g. VELCRO brand fastening structure) type strips or sections or loop type structures. When exemplified by hook and loop type strips or sections, it is contemplated that hook material sections 24 may be preferably and permanently (e.g. adhesively) attached to outer surfacing of the outer planar members 18 and 19 adjacent the clamp ends 23 such that loop material sections 25 may be removably and cooperably fastened to the hook material sections 24 for providing effective, low cost clamping means at the clamp ends 23.

Once the loop material sections 25 are removably and cooperably fastened to the hoop material sections 24, then the resulting compressive forces may well operate to press the target garment section 101 received intermediate the first and second outer planar members 18 and 19 so as to remove any wrinkles otherwise present in the pressed target garment section 101. It is noted that the tension in loop material sections 25 may be adjusted (typically by way of manually compressing the members 18 and 19 toward one another before fastening the loop material sections 25 to the hook material sections 24) so as to impart selectively increased or decreased compressive forces into the pressed target garment section(s) 101.

In summary, it will be seen that the first and second outer planar members 18 and 19 each have a hinge end as at 22 and a clamp end as at 23; a first flexible hinge member as at 21 is flexibly attached at the hinge ends 22 for interconnecting the hinge ends 22 (akin to a book binding). Further, certain clamping means as hereinabove exemplified function to clamp the clamp ends 23 of the outer planar members 18 and 19 toward one another.

A garment section 101 is received intermediate the first and second outer planar members 18 and 19 as well as intermediate and the first flexible hinge member 21 and clamping means. The first and second outer planar members 18 and 19 thus function to impart garment-compressive, wrinkle-removing forces 102 into the received, pressed target garment section 101 when the clamping means clamp or compress the clamp ends 23 toward one another.

The portable garment press assembly according to the present invention may further preferably comprise an inner planar member or assembly. In this regard, the reader is directed to an inner planar member as depicted and referenced at 26. In this regard, it may be seen that in certain applications it would be preferable to simultaneously press paired sections or opposed garment sections 101 of a target garment during a single pressing episode.

The inner planar member 26 (or assembly) may thus be utilized as a dividing plane intermediate opposed garment sections 101(*a*) and 101(*b*) as generally depicted in FIGS. 9, 10, and 12-15. In this regard, it will be seen that first garment section 101(*a*) is positioned atop the inner surfacing of the first outer planar member 18, and the inner planar member 26 (or assembly) is positioned atop the first garment section 101(*a*). Then a second garment section 101(*b*) is positioned atop the outer surfacing of the inner planar member 26 (or assembly) and then the second outer planar member 19 is positioned atop the second garment section 101(*b*).

Once the bottom to top layers (i.e. first outer planar member 18; first garment section 101(*a*); inner planar member 26 (or assembly); second garment section 101(*b*); and second outer planar member 19) are properly positioned, the clamping means may be fastened at the clamp ends 23 so as to direct compressive forces as at 102 into the members 18 and 19 while tension is applied to the hinge member 21 and the (flexible) clamping means as at 105.

Preferably, the inner planar member 26 is permanently (e.g. adhesively) attached to the hinge member 21 as generally depicted in enlarged fragmentary sectional FIG. 9(*a*). In addition, it is contemplated that the inner planar member 26, comprising opposed, outer surfacing, may well further comprise compressive padding and/or hydrophobic surfacing as at 30 (thus forming an inner planar member assembly) for pad-compressing contacting target garment sections; and for further resisting moisture absorption by the inner planar member 26.

Once the primary garment-compressing, wrinkle-removing forces are arranged and set into the target garment section (s) 101 via the hinge member 21, members 18 and 19, and clamping means (as exemplified by material sections 24 and 25), it is contemplated that additional clamping means may be applied to the assembly so as to impart secondary garment-compressing, wrinkle-removing forces 100 into the target garment section(s) 101.

In this regard, as has been noted, it is contemplated that the first and second outer substantially planar members 18 and 19 are preferably formed from a resilient (moderately elastic) material, which material may be resiliently bent such that once the tension across the bending direction has been removed, the material returns to its relaxed unbent, substantially planar state. Additional tensioning means are contemplated that extend longer than the length of the members 18 and 19 so as to be able to structurally place a member-bending tension intermediate the hinge ends 22 and the clamp ends 23.

In other words, it is contemplated that the portable garment press assembly may well comprise certain tensioning means for interconnecting the hinge ends 22 to the clamp ends 23 so as to resiliently and arcuately bow the members 18 and 19 via the tensioning means, which members 18 and 19 may thereafter be retained in bowed tension as generally depicted in FIGS. 5 and 16 for imparting the secondary garment-compressive wrinkle-removing forces 100 into the received/pressed target garment section(s) 101.

It is contemplated that the tensioning means for interconnecting hinge ends 22 to clamp ends 23 may be exemplified by at least two different types of tensioning means. In the first instance, it is noted that the clamping means may comprise a member-attached section as exemplified by hook material section 24 along with the flexible loop material section or clamp 25. Together, the member-attached section 24 (permanently (i.e. adhesively) attached to the outer surfacing of the members 18 and 19 at the clamp ends) and the flexible material section 25 together function to clamp or compress the clamp ends 23 of the outer planar members 18 and 19 toward one another.

Given this exemplary construction, it is contemplated that the first flexible hinge member 21 may preferably comprise certain outer hinge surfacing and that the member-attached section or material section 24 comprise similar outer clamp surfacing. As has been exemplified, the outer surfacing of material section 24 is illustrated as hook type structure 31. Accordingly, it is contemplated that the outer hinge surfacing of the flexible hinge member 21 may well comprise hook type material surfacing as at 31. Together, the outer hinge surfacing and material section 24 surfacing comprise or provide first fastening means (e.g. hook type fastening means as at 31).

It is thus contemplated that the tensioning means for interconnecting the hinge ends 22 to the clamp ends 23 may thus be formed from at least one, but preferably two or more strips or straps of material or material strips 32 comprising matable or second fastening means cooperable with the first fastening means. Given the foregoing example, it is contemplated that the tensioning means or each material strip or strap as at 32 may well comprise loop type fastening means as depicted and referenced at 33.

Thus, the firstly exemplified tensioning means comprise second or loop type fastening means 33, which means are cooperable or matable with the first fastening means or hook type fastening means 31 for fastening the tensioning means to the first flexible hinge member 21 and member-attached section or material section 24 for retaining the outer (substantially planar) members 18 and 19 in a bowed configuration provided the members 18 and 19 are arcuately bent prior to tension application (as depicted at vectors 106) through the tensioning means.

Figure 7:
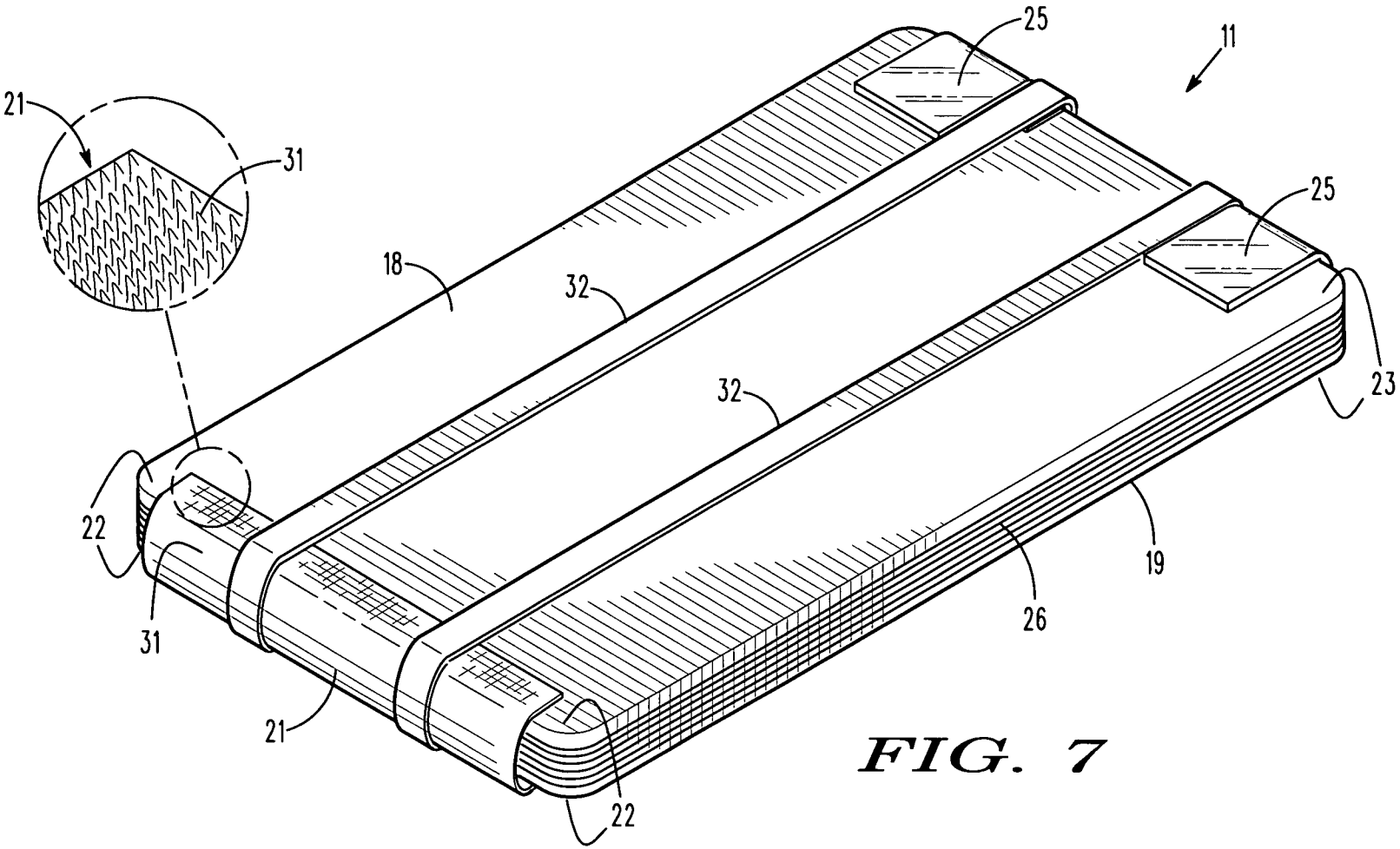
FIG. 7 is a bottom perspective view of a third alternative embodiment of the portable garment press assembly according to the present invention showing tension straps, a hinge member and flexible clamping structures (the tension straps being fastened adjacent the flexible clamping structures) for holding a series of substantially planar members in stacked relation.
Figure 8:
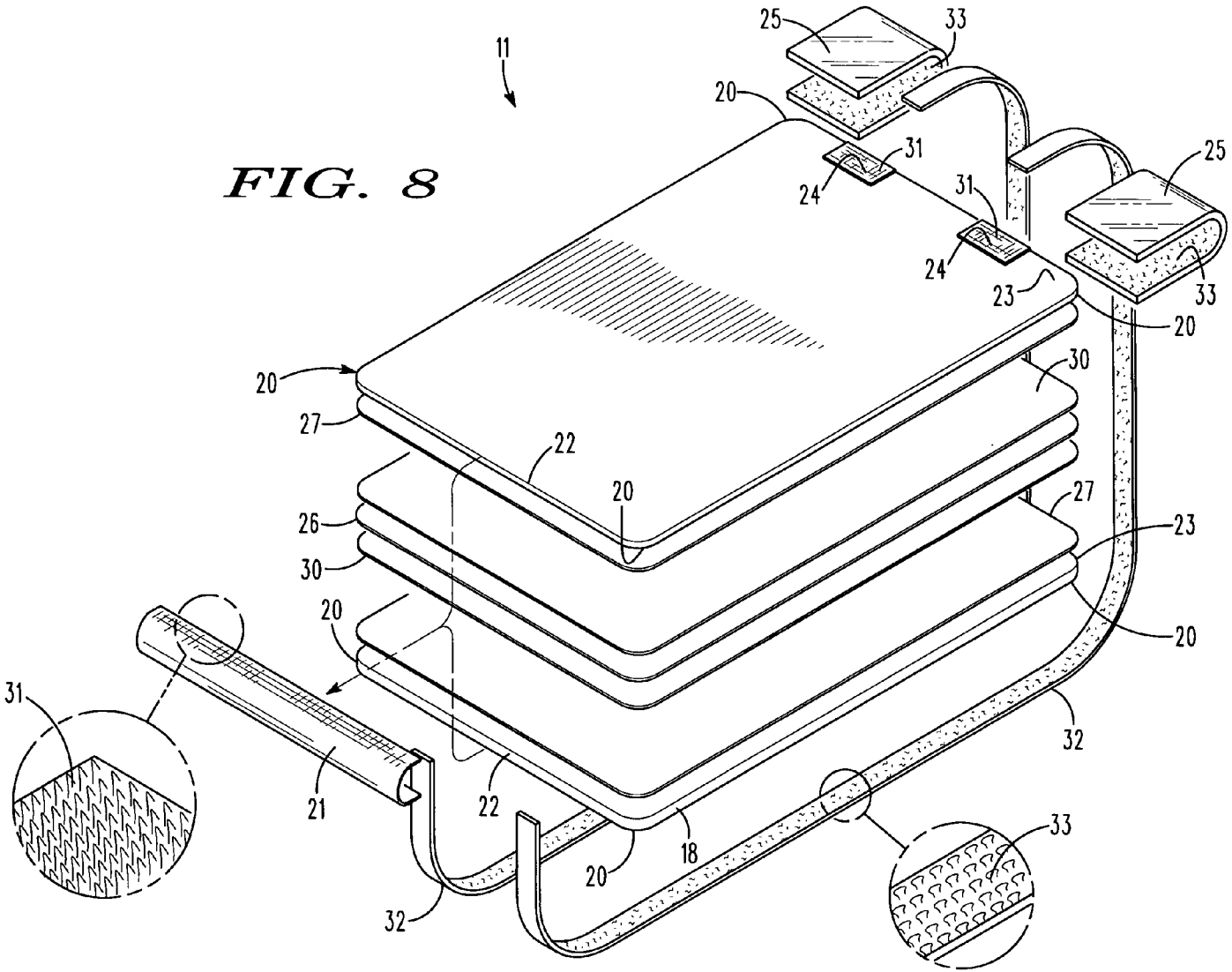
FIG. 8 is a bottom exploded perspective view of the third alternative embodiment of the portable garment press assembly according to the present invention showing tension straps, a hinge member and flexible clamping structures for holding a series of substantially planar members in stacked relation.
Figure 11A:
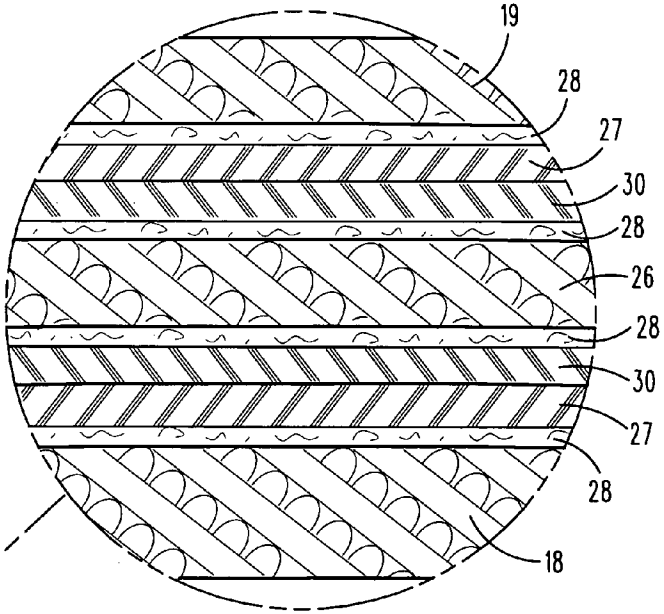
FIG. 11 is a fragmentary side elevational view of the third alternative embodiment of the portable garment press assembly according to the present invention showing multiple layers of materials with a hinge structure, a tension strap and flexible clamping structures retaining the layered materials in stacked relation.
Figure 11:
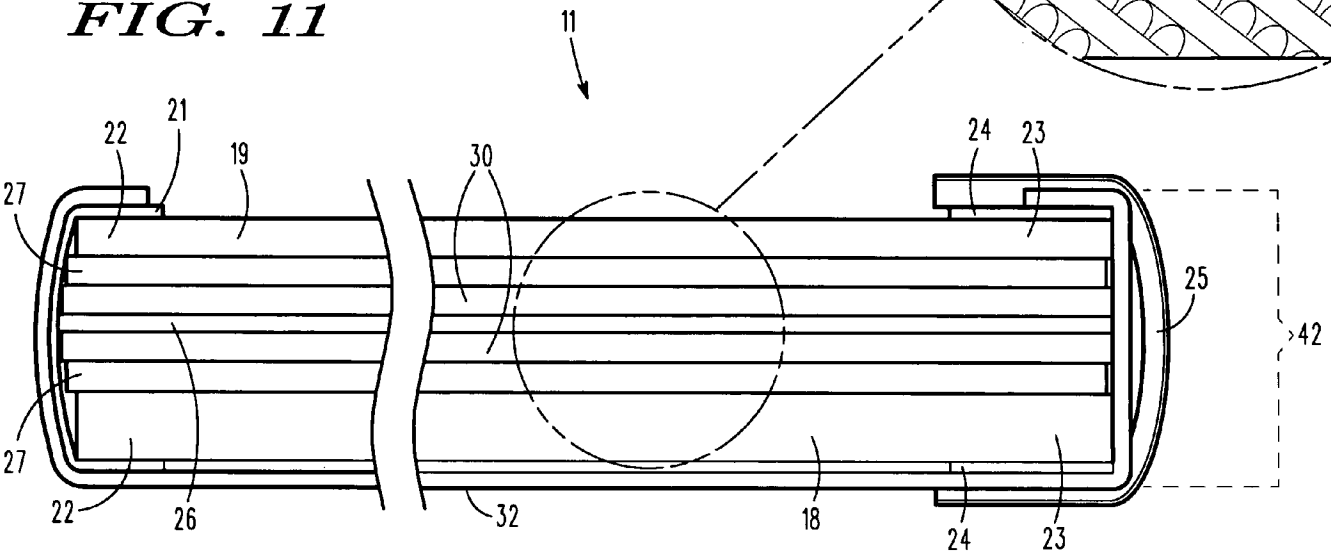

It should be noted that when material strip or strap 32 is utilized to exemplify the tensioning means as described, the strip or strap 32 may preferably be situated adjacent material section 25 as both strip or strap 32 and section 25 are removably fastened to material section 24. This arrangement is perhaps most easily viewed from a comparative inspection of FIGS. 7 and 8.

By adjusting the mated placement of the material strip or strap 32 relative to the flexible hinge member 21 and/or the material section or member-attached section 24, the user may adjust the length of the material strip or strap 32 for increasing or reducing the inner radius of the arcuately bent ensemble (comprising resilient members 18 and 19 (and 26)), and thereby adjust the tension 106 in the strip or strap 32 as well as the compressive forces 100 directed through the garment section(s) 101. It is thus contemplated that the tensioning means may be length-adjustable for enabling the user to selectively vary the (secondary) garment-compressive, wrinkle-removing forces.

Secondly, certain other tensioning means may also be exemplified by at least one, but preferably two or more loop structures (akin to belt(s)) as generally depicted and referenced at 35. The loop structures 35 each preferably comprise a length-adjusting buckle arrangement or mechanism as at 36. It will be recalled that portable garment press assembly 11 comprises tensioning means in the form of a material strip or strap 32. Select fastening means are required to cooperably mate with the fastener surfacing of the strap 32, which means must otherwise be attached to the hinge ends 22 and clamp ends 23.

The loop structures 35, however, eliminate the absolute structural need for a flexible hinge member 21 with or without surfacing 31. Further, the loop structures 35 eliminate the absolute structural need for material or member-attached sections 24 insofar as the lengthwise looped relation of the loop structures 35 around both the first and second outer substantially planar members 18 and 19 functions first to clamp or compress both the hinge ends 22 and the clamp ends 23 toward one another when the loop structure 35 is placed into sufficient tension 106 via the buckle mechanism 36.

Figure 2:
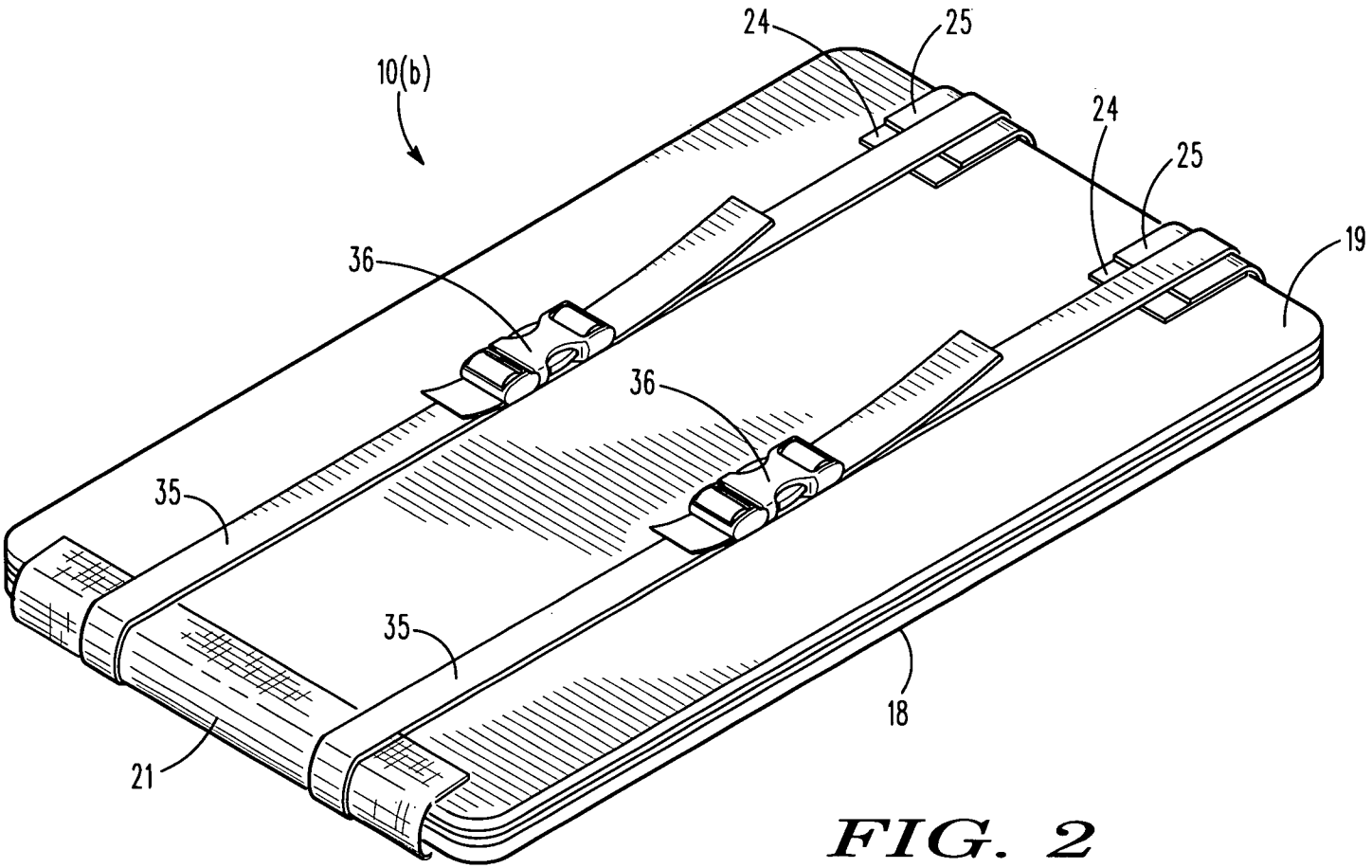
FIG. 2 is a bottom perspective view of a second alternative embodiment of the portable garment press assembly according to the present invention showing looped straps, a hinge member and flexible clamping structures (the looped straps being looped over the flexible clamping structures) for holding a series of substantially planar members in stacked relation.
Figure 3:
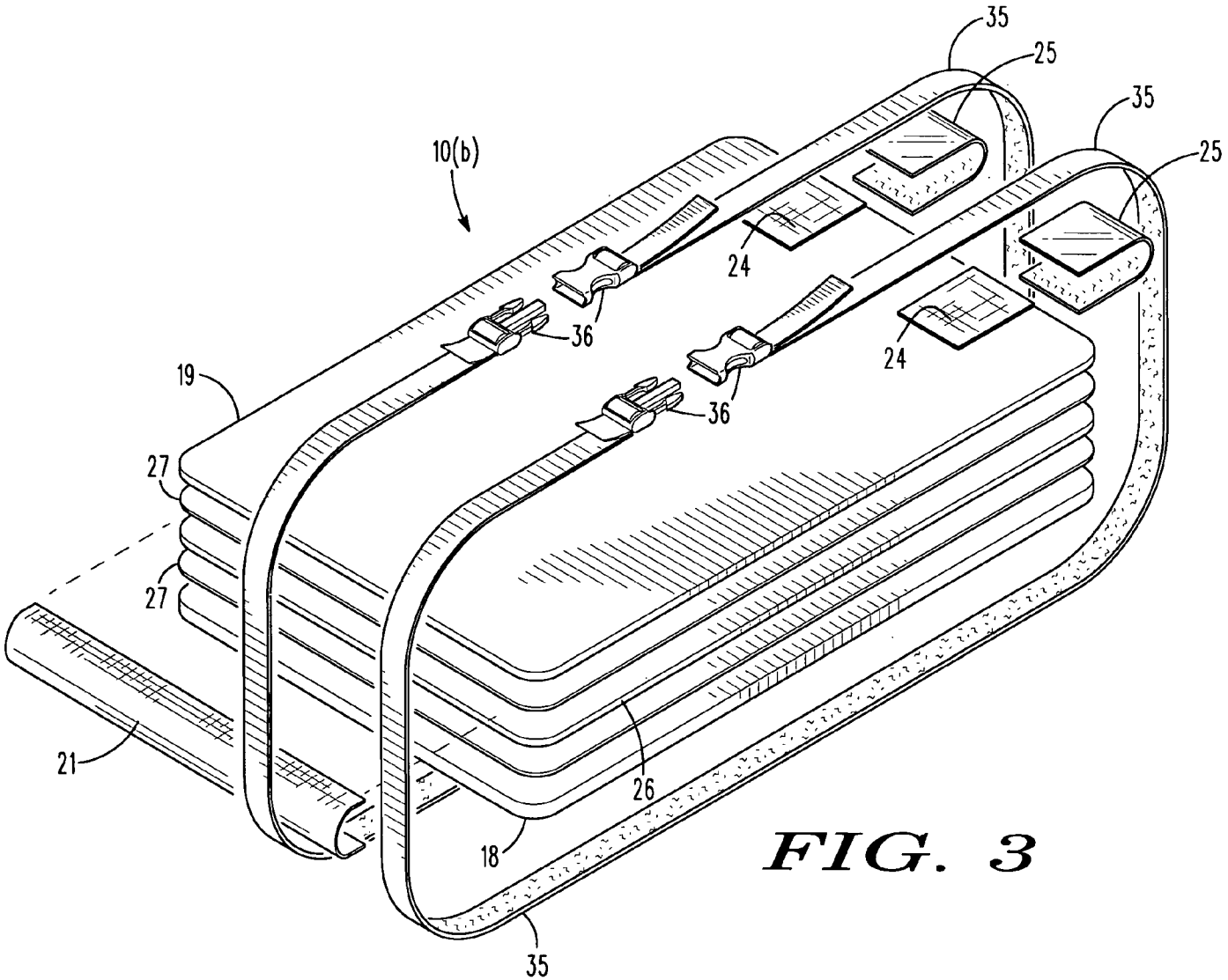
FIG. 3 is a bottom exploded perspective view of the second alternative embodiment of the portable garment press assembly according to the present invention showing looped straps, a hinge member and flexible clamping structures (the looped straps being looped over the flexible clamping structures) for holding a series of substantially planar members in stacked relation.
Figure 4:
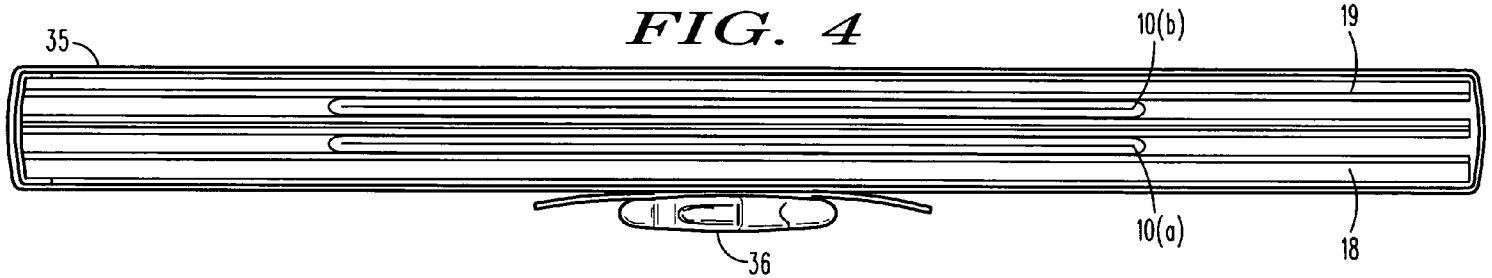
FIG. 4 is a side elevational view of the second alternative embodiment of the portable garment press assembly according to the present invention (with clamping structures removed) showing first and second garment sections received or sandwiched intermediate a series of planar members with a looped strap retaining the substantially planar members and pressed garment sections in stacked relation.

FIGS. 1, 2, and 4 show the loop structure(s) 35 in a relatively relaxed state with sufficient 106 to clamp the hinge ends 22 and the clamp ends 23 toward one another such that the first and second outer planar members 18 and 19 remain substantially planar. FIG. 5 may be compared with FIG. 4, however, which comparative views will more clearly show the reader the loop member(s) 35 with sufficient tension 106 to arcuately bend the first and second outer (planar) members 18 and 19 in a direction orthogonal to the plane of tension 106 within loop structure(s) 35 (in FIG. 5) as opposed to simply clamping or compressing the hinge ends 22 and clamp ends 23 toward one another.

It is thus contemplated that the portable garment press assembly 10 is the preferred embodiment insofar as loop members 35 enable the elimination of certain fastening means otherwise necessary to practice assembly 11. Notably, the fastening means of assembly 11 may optionally be utilized in combination with the loop member(s) 35. For example, it is contemplated that the hinge ends 22 and the clamp ends 23 may be first held together via the aforesaid hinge member and fastening means, and this may effect more stabilized compression.

In combination with the loop member(s) 35, however, the hinge member and matable fastening means effect a superior compressive arrangement. It is thus contemplated that the tensioning means, whether by strap 32 or by loop member 35 may be length-adjustable for enabling the user to selectively vary the garment-compressive forces when the members 18 and 19 are arcuately bent and retained in such a structural configuration.

It should be further noted that the first and second outer substantially planar members 18 and 19 may well comprise varied relative thickness as generally and comparatively depicted throughout the figures. In other words, member 18 comprises a relatively greater thickness as compared to the thickness of member 19. It is contemplated, that the preferred method of bending the press assembly complex comprises the step of bending the ensemble in the direction of the outer planar member having relatively less thickness (e.g. member 19). Excellent wrinkle-removing results have been shown when the outer planar member inward to the bend is of relatively greater thickness than the outer planar member outward to the bend.

It is thus contemplated that the varied relative thickness as between the first and second outer substantially planar outer planar members 18 and 19 may well enable the user or traveler to selectively vary the amount of garment-compressive forces otherwise directed into the arcuately bent ensemble. For example, if a different magnitude of compressive forces is desired, the user/garment presser may simply bend the ensemble in a different direction relative to the member thickness.

Figure 17:
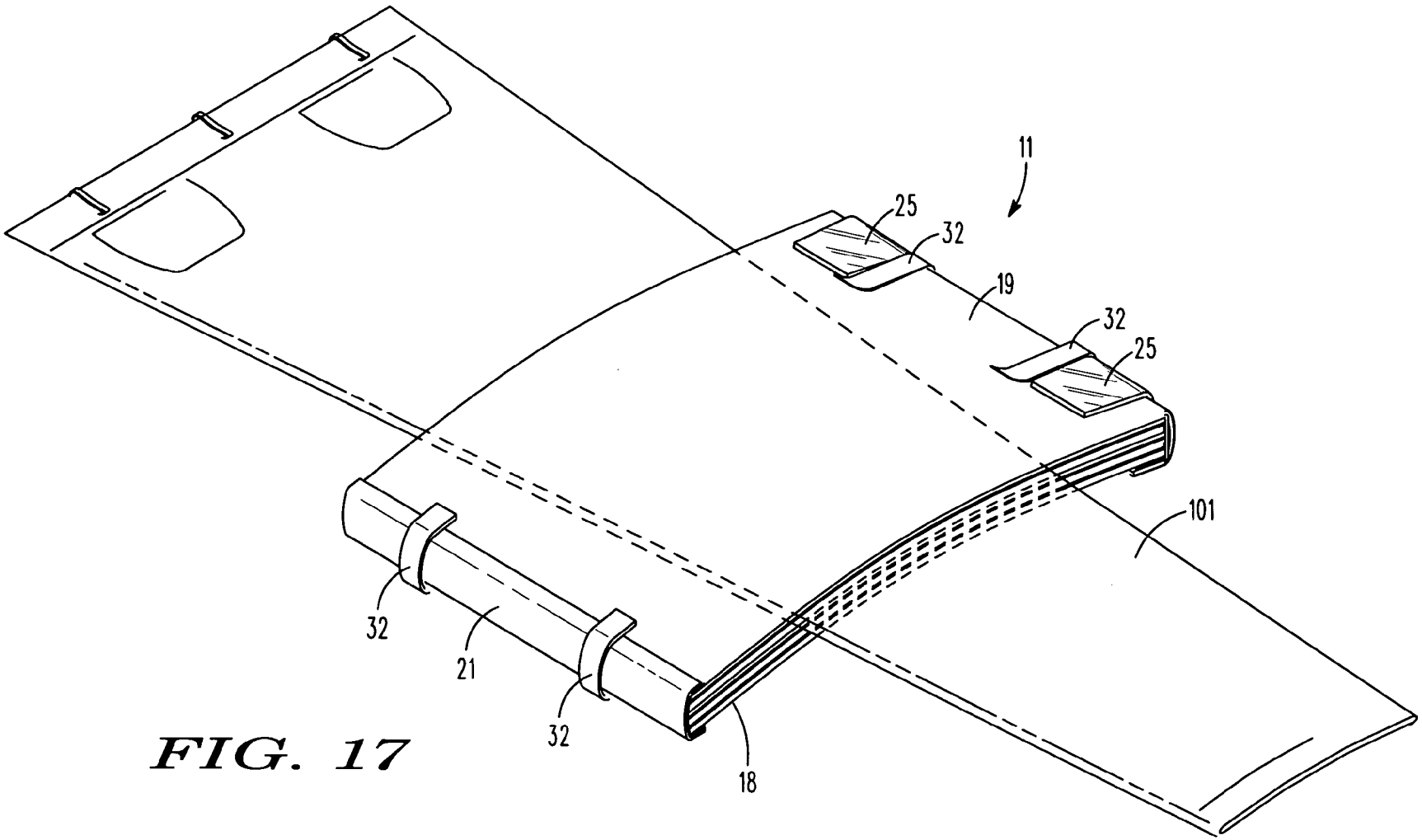
FIG. 17 is a top perspective view of the third alternative embodiment of the portable garment press assembly showing a trouser section received via the third alternative embodiment shown being retained in arcuately bowed relation.

Similar thicknesses of the outer planar members, however, may also be employed, as generally depicted in FIG. 17(*b*). It may be seen from a comparative inspection of FIG. 17(*a*) versus FIG. 17(*b*), for example, that first outer planar member 18 has a varied thickness as compared to second outer planar member 19, but that first outer planar member 18(*a*) has a similar thickness as compared to second outer planar member 19.

The portable garment press assembly 12 preferably comprises substantially identically paired first and second outer planar members 18 and 19 with first flexible hinge members 21 and clamping means (e.g. the combination of material sections 24 and 25) for joining the hinge ends 22 and clamp ends 23 to one another. In other words, it is contemplated that the portable garment press assembly 12 is formed by placing substantially identical assemblies 11 next to one another along a junction edge 37 extending intermediate the hinge ends 22 and clamp ends 23. The junction edges 37 of adjacent assemblies 11 are interconnected by a third flexible hinge member 38 akin to first hinge member 21.

Figure 20:
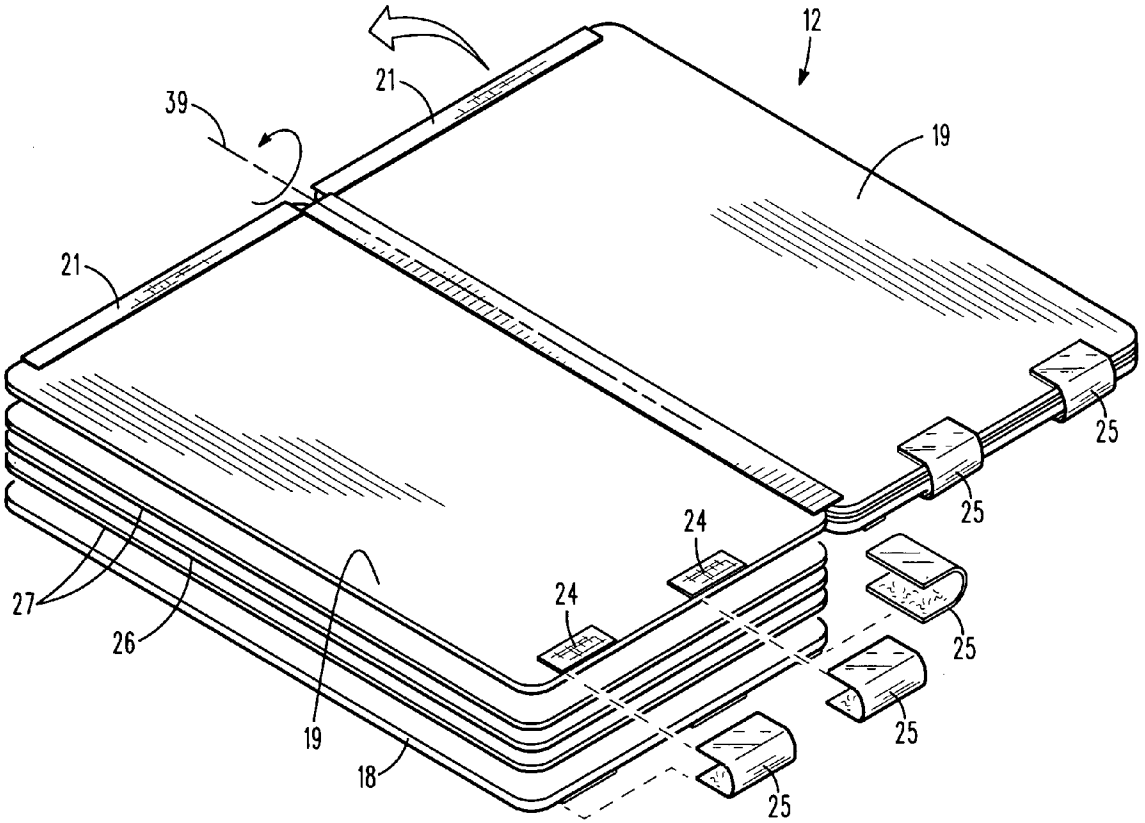
FIG. 20 is a bottom partially exploded perspective view of the fourth alternative embodiment of the portable garment press assembly according to the present invention showing side by side portable garment press assemblies of the third alternative type showing first, second, and third hinge structures through which third hinge member a fold axis is depicted.
Figure 21:
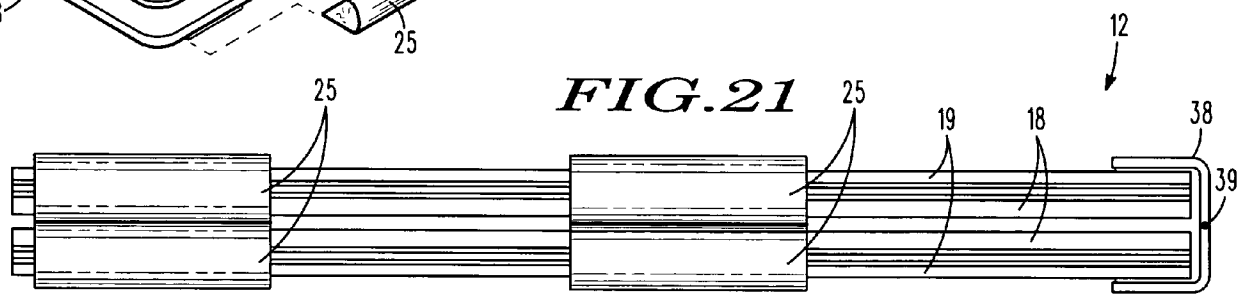
FIG. 21 is an end elevational type depiction of the fourth alternative embodiment of the portable garment press assembly according to the present invention showing the portable garment press assemblies of the third alternative type in collapsed stacked relation by way of the folded third hinge structure or member.

The third flexible hinge member 38 comprises a fold axis as at 39 such that the paired assemblies 11 may be folded about the fold axis 39 so as to be placed into a more compact folded arrangement as generally depicted in FIG. 20. The folded assembly 12 may thus be placed into the luggage assembly 14 as generically depicted in FIGS. 23 and 24. It is contemplated that the hinge ends 22 and clamp ends 23 of the portable garment press assembly 12 may be similarly outfitted with tensioning means of the type hereinabove exemplified so as to impart an arcuately bowed structural configuration for imparting secondary garment-compressing and/or wrinkle-removing forces into pressed garment sections 101.

Figures 18, 18A, 18B:
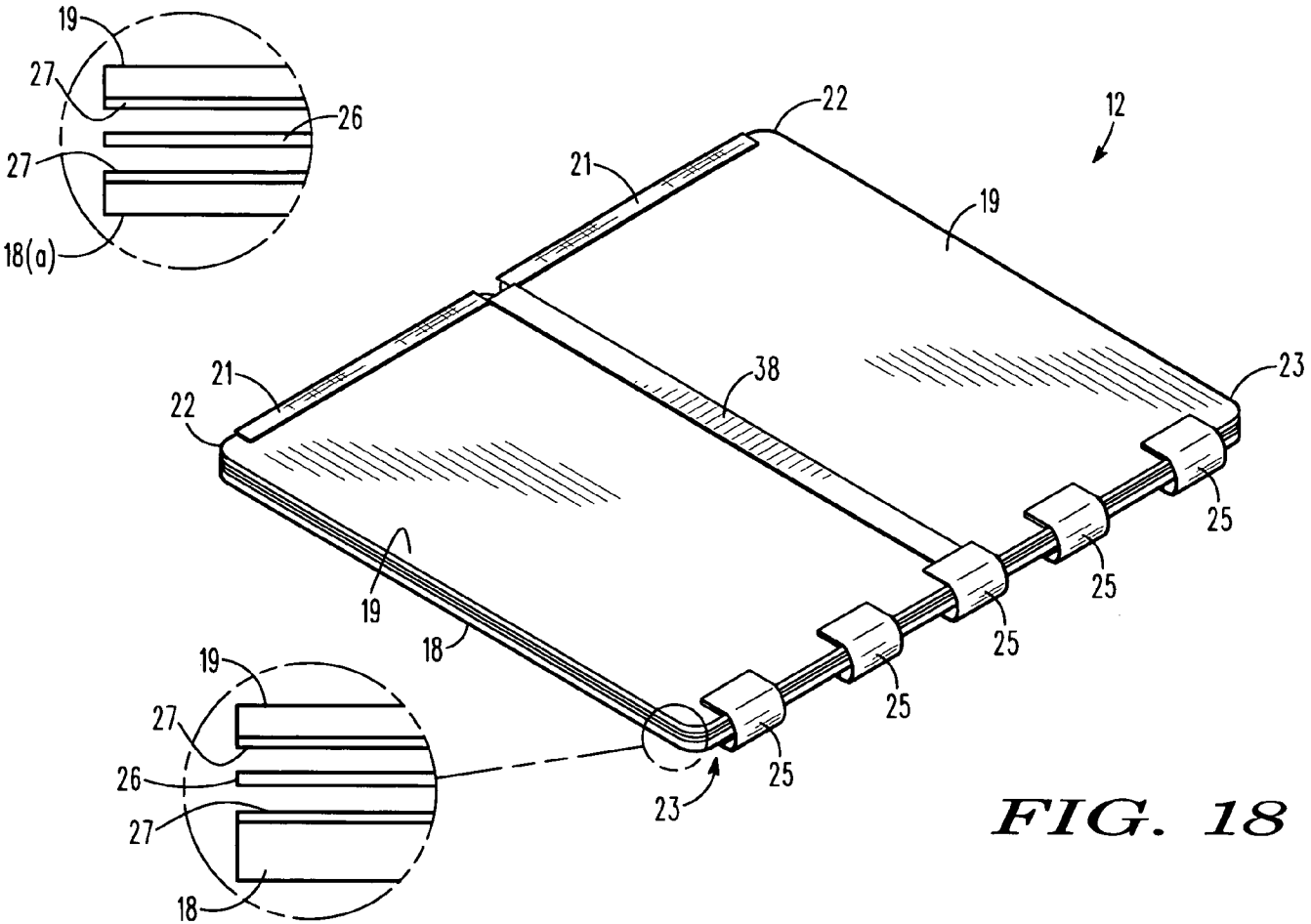
FIG. 18 is a bottom perspective view of a fourth alternative embodiment of the portable garment press assembly according to the present invention showing side by side portable garment press assemblies of the third alternative type joined by a flexible hinge structure at the junction therebetween along with first and second hinge structures or members and a series of flexible clamping structures for holding a series of substantially planar members in stacked relation.
Figure 19:
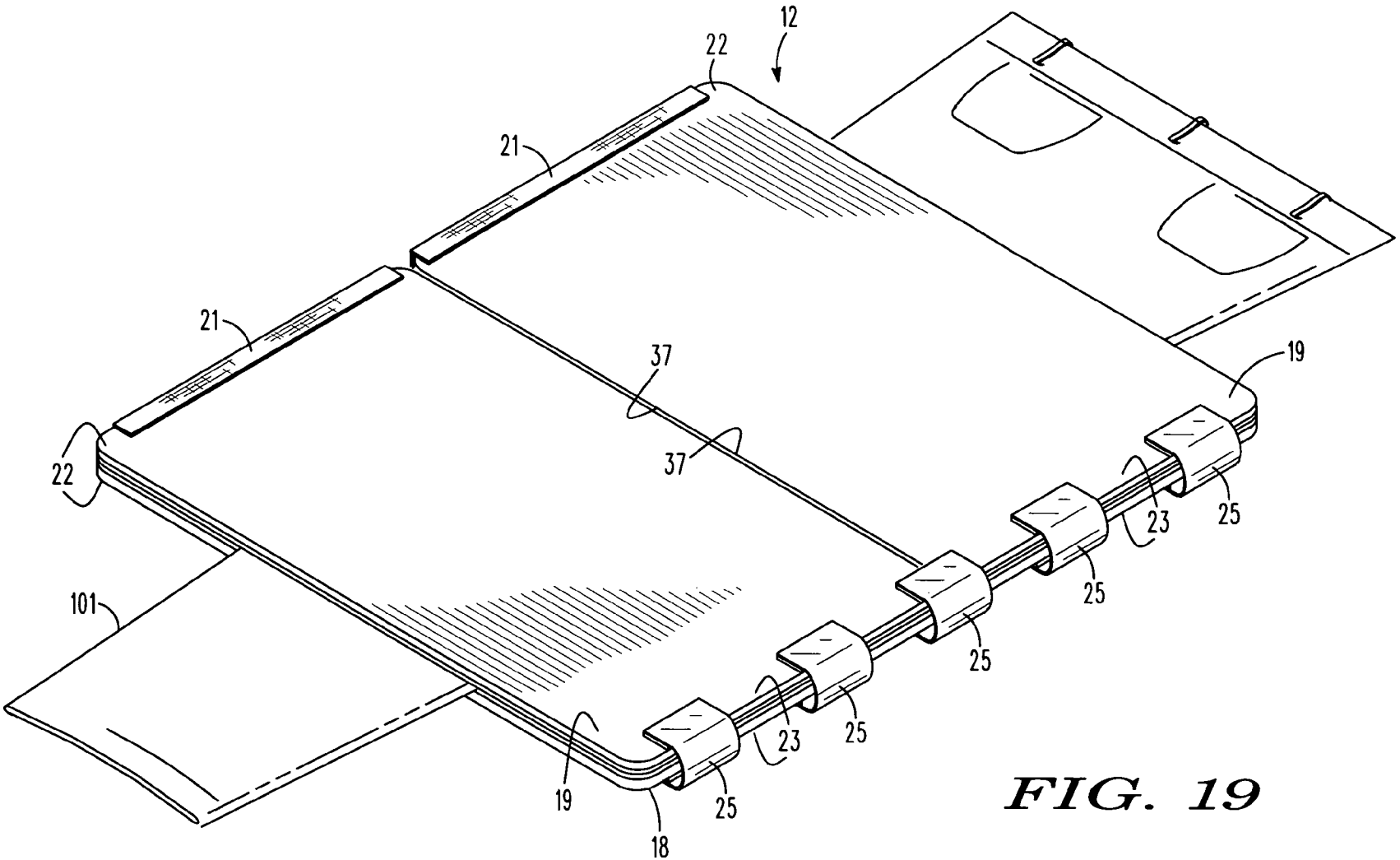
FIG. 19 is a top perspective view of the fourth alternative embodiment of the portable garment press assembly according to the present invention showing side by side portable garment press assemblies of the third alternative type showing first and second hinge structures or members and a series of flexible clamping structures for pressing a relatively longer trouser garment section.

Portable garment press assembly 12 is designed with a particular view toward simultaneously pressing longer sections of garments received therein as generally depicted in FIG. 18. Similarly, portable garment press assembly 13 is designed to achieve a similar result as generally depicted in FIG. 22. The primary difference between assembly 12 and assembly 13 is that the latter assembly does not fold at junction edges 37 or about fold axis 39.

It will be seen that assembly 13 comprises a first outer substantially planar member 18(*b*) (relatively longer than members 18 and 18(*a*)); a second outer substantially planar member 19(*a*) (relatively longer than member 19); and an inner planar member 26(*a*) (relatively longer than member 26). Further, a first hinge member 21(*a*) is relatively longer in dimension than first hinge member 21 so as to more properly hinge connect the hinge ends 22.

In this regard, it is contemplated that assembly 13 may be used primarily within home-based scenarios for pressing relatively longer garment sections simultaneously. Tensioning means of the type hereinabove exemplified may also be utilized in combination with the portable garment press assembly 13 to impart an arcuately bowed structural configuration for imparting secondary garment-compressing and/or wrinkle-removing forces into pressed garment sections 101.

While the foregoing specifications set forth much specificity, the same should not be construed as setting forth limits to the invention but rather as setting forth certain preferred embodiments and features. For example, as prefaced hereinabove, it is contemplated that the present invention essentially provides a portable garment press assembly as at (10(*a*), 10(*b*), 11, 12, and 13), a travel kit assembly, and certain methods associated therewith for enabling travelers to mechanically press garments or garment sections 101. It is believed that the portable garment press assembly according to the present invention essentially comprises first and second outer planar members, each of which has a hinge end and a clamp end.

Further, the essential portable garment press assembly comprises a first flexible hinge structure or member flexibly attached at the hinge ends of the outer planar members for interconnecting the hinge ends; and certain clamping means for clamping the clamp ends of the outer planar members toward one another. The clamping means may preferably comprise a member-attached section (as at 24) and a flexible clamp or clamping material section (as at 25). The member-attached section 24 and the flexible clamp 25 together clamp the clamp ends of the outer planar members toward one another.

A garment section may be received intermediate (1) the first and second outer planar members and (2) the first flexible hinge and clamping means. The first and second outer planar members function to impart garment-compressive and/or wrinkle-removing forces into a received garment section when the clamping means clamp the clamp ends toward one another.

The portable garment press assembly may optionally comprise an inner planar member sandwiched intermediate the first and second outer planar members and preferably attached to the first flexible hinge member. It is contemplated that the inner planar member may well function to separate opposed garment sections as received intermediate the first and second outer planar members. The inner planar member may preferably comprise opposed hydrophobic or polymeric padded surfacing as at 30 for resisting moisture absorption by the inner planar member.

In contradistinction thereto, the first and second outer planar members may each preferably comprise inner hydrophilic, moisture absorptive, or moisture wicking surfacing as at 27 for enhancing moisture absorption from garment sections coming into contact therewith, provided the user/traveler opts to moisture the garment sections before pressing the garment sections with the portable press assembly according to the present invention. Further, a select outer planar member (with hydrophilic surfacing) may optionally comprise at least one, but perhaps a series of apertures (as at 29) extending orthogonally relative to the plane of the select outer planar member enabling moisture to pass therethrough.

A central feature to the practice of the present invention is the outer (and inner) planar members are preferably constructed from a semi-rigid resilient (bendable) material.

When used in combination with certain tensioning means as exemplified throughout the specifications, said tensioning means may well function to interconnect the hinge ends 22 to the clamp ends 23. Thus interconnected, the outer planar members may be resiliently and arcuately bowed via the tensioning means and retainable in bowed tension for imparting wrinkle-removing forces to received garment section(s).

The first flexible hinge structure or member (as at 21) may preferably comprise outer hinge surfacing (as at 31) and the member-attached section may preferably comprise outer clamp surfacing (as at 31). It will thus be understood that the outer hinge and clamp surfacing comprises certain first fastening means. The tensioning means may well preferably comprise certain second fastening means such that the first and second fastening means are cooperable for fastening the tensioning means to the first flexible hinge and member-attached section for retaining the outer planar members in bowed tension as generally depicted in FIG. 16.

It is contemplated that the tensioning means are length-adjustable for enabling the user to vary the garment-compressive and/or wrinkle-removing forces. When the tensioning means are exemplified by looped members or straps (as at 35) it is contemplated that the tensioning means may be looped around the hinge ends and clamp ends for interconnecting the hinge ends to the clamp ends, and that the looped tensioning means are loop-adjustable (e.g. via a buckle mechanism as at 36) for enabling the user to vary the garment-compressive and/or wrinkle-removing forces.

The portable garment press assembly may comprise substantially identically paired first and second outer planar members with first flexible hinge structures or members and certain clamping means for joining the same. In other words, the portable garment press assembly 13 may comprises two assemblies 11 (or two assemblies 10(*a*) or 10(*b*), but are joined together (via a select set of outer planar members (e.g. the first outer planar members or the second outer planar members) by a second (or third) flexible hinge structure or member (as at 38) at a paired-member junction (as at junction edges 37) intermediate the paired first and second outer planar members. The paired first outer planar members (or second outer planar members) are foldable about the second flexible hinge member (e.g. along fold axis 39) for collapsing the portable garment assembly, which then may be inserted into a luggage assembly (as at 14).

In addition to the foregoing structural considerations, it is further believed that the inventive concepts discussed support certain new methodologies and/or processes. In this regard, it is contemplated that the foregoing structure considerations support a method for mechanically pressing a garment section comprising the steps of initially providing a portable garment press assembly comprising opposed resilient outer planar members interconnected at hinge ends thereof by a hinge structure.

A garment section may thus be positioned upon a first of the opposed outer planar members, and a second of the opposed outer planar members may be positioned into contact with the garment section via the hinge structure. Notably, moisture (as at 103) may be added to the garment section before positioning the second outer planar member into contact with the garment section.

The opposed outer planar members may then be clamped toward one another at clamp ends thereof for imparting primary garment-compressive, wrinkle-removing forces into the received garment section. The hinge ends may be interconnected to the clamp ends with certain tensioning means for resiliently and arcuately bowing the outer planar members for imparting secondary garment-compressive and/or wrinkle-removing forces into the garment section.

In view of the fact that the portable garment press assembly may comprise an inner planar member, the method for mechanically pressing a garment section may further comprise the step of separating opposed garment sections via the inner planar member as received intermediate the opposed outer planar members. Further, as has been noted, the hinge structure may preferably comprise certain outer hinge surfacing and the clamping means may comprise certain outer clamp surfacing.

Together the outer hinge and clamp surfacing thus define certain first fastening means matable with second fastening means outfitted upon the tensioning means. The first and second fastening means are thus cooperable for fastening the tensioning means to the hinge structure and clamping means for retaining the outer planar members in bowed tension.

The user or traveler may selectively vary the garment-compressive and/or wrinkle-removing forces by bowing the outer planar members in a select direction as selected from two possible directions (i.e. toward the first outer planar member or toward the second outer planar member). It will be recalled that the outer planar members may comprise varied relative thickness, which varied relative thickness is believed to enable the user to selectively vary the wrinkle-removing forces. Additionally, the tension in the tensioning means may be adjusted for varying the garment-compressive and/or wrinkle-removing forces.

Accordingly, although the invention has been described by reference to certain preferred embodiments and certain methodologies, it is not intended that the novel arrangement and methods be limited thereby, but that modifications thereof are intended to be included as falling within the broad scope and spirit of the foregoing disclosures and the appended drawings.

I claim:

1. A travel kit for enabling travelers to mechanically press garments during travel, the luggage kit comprising:

a three-dimensional luggage assembly, the luggage assembly thus having a luggage length, a luggage width, and a luggage depth; and a portable garment press assembly, the portable garment press assembly being sized and shaped to be received within the luggage length, width, and depth, the portable press assembly comprising:

first and second outer planar members, the first and second outer planar members each having a hinge end and a clamp end, the outer planar members each comprising inner hydrophilic surfacing, the inner hydrophilic surfacing for enhancing moisture absorption from garment sections coming into contact therewith;

a first flexible hinge member, the first flexible hinge member being flexibly attached at the hinge ends for interconnecting the hinge ends;

an inner planar member, the inner planar member being sandwiched intermediate the first and second outer planar members and attached to the first flexible hinge member, the inner planar member for separating opposed garment sections as received intermediate the first and second outer planar members; and clamping means for clamping the clamp ends of the outer planar members toward one another, a garment section being receivable intermediate the first and second outer planar members and the first flexible hinge member and clamping means, the first and second outer planar members for imparting primary wrinkle-removing forces into a received garment section when the clamping means clamp the clamp ends toward one another.

2. The travel kit of claim 1 wherein the inner planar member comprises opposed hydrophobic surfacing, the hydrophobic surfacing for resisting moisture absorption by the inner planar member.

3. The travel kit of claim 1 wherein the outer planar members are resilient, the portable garment press assembly comprising tensioning means for interconnecting the hinge ends to the clamp ends, the outer planar members being resiliently and arcuately bowable via the tensioning means and retainable in bowed tension thereby for imparting secondary wrinkle-removing forces to received garment section(s).

4. The travel kit of claim 1 wherein the clamping means comprise a member-attached section and a flexible clamp, the member-attached section and the flexible clamp together for clamping the clamp ends of the outer planar members toward one another.

5. The travel kit of claim 3 wherein the first flexible hinge member comprises outer hinge surfacing and the member-attached section comprises outer clamp surfacing, the outer hinge and clamp surfacing comprising first fastening means, the tensioning means comprising second fastening means, the first and second fastening means being cooperable for fastening the tensioning means to the first flexible hinge and member-attached section for retaining the outer planar members in bowed tension.

6. The travel kit of claim 1 wherein a select outer planar member comprises an aperture extending orthogonally relative to the plane of the select outer planar member, the aperture for enabling moisture to pass therethrough.

7. The travel kit of claim 3 wherein the first and second outer planar members comprise varied relative thickness, the varied relative thickness for enabling the user to selectively vary the garment-compressive forces.

8. The travel kit of claim 3 wherein the tensioning means are length-adjustable for enabling the user to vary the garment-compressive forces.

9. The travel of claim 3 wherein the tensioning means are looped around the hinge ends and clamp ends for interconnecting the hinge ends to the clamp ends, the looped tensioning means being loop-adjustable for enabling the user to vary the garment-compressive forces.

10. The travel kit of claim 1 wherein the portable garment press assembly comprises substantially identically paired first and second outer planar members with first flexible hinge members and clamping means for joining the same, the paired first outer planar members being joined by a third flexible hinge member at a paired-member junction intermediate the paired first and second outer planar members, the paired first outer planar members being foldable about the third flexible hinge member for collapsing the portable garment assembly.

11. A portable garment press assembly for enabling travelers to mechanically press garments, the portable garment press assembly comprising:

first and second outer planar members, the first and second resilient outer planar members each having a hinge end and a clamp end;

a first hinge member, the first hinge member being attached at the hinge ends for interconnecting the hinge ends; and clamping means for clamping the clamp ends of the outer planar members toward one another; and tensioning means for interconnecting the hinge ends to the clamp ends, a garment section being receivable intermediate the first and second outer planar members and the first hinge member and clamping means, the first and second outer planar members for imparting wrinkle-removing forces into a received garment section when the clamping means clamp the clamp ends toward one another, the outer planar members resiliently and arcuately bowable via the tensioning means and retainable in bowed tension thereby for imparting wrinkle-removing forces to received garment section(s).

12. The portable garment press assembly of claim 11 comprising an inner planar member, the inner planar member being sandwiched intermediate the first and second outer planar members and attached to the first hinge, the inner planar member for separating opposed garment sections as received intermediate the first and second outer planar members.

13. The portable garment press assembly of claim 11 wherein the outer planar members each comprise inner hydrophilic surfacing, the inner hydrophilic surfacing for enhancing moisture absorption from garment sections coming into contact therewith.

14. The portable garment press assembly of claim 12 wherein the inner planar member comprises opposed hydrophobic surfacing, the hydrophobic surfacing for resisting moisture absorption by the inner planar member.

15. The portable garment press assembly of claim 11 wherein the clamping means comprise a member-attached section and a flexible clamp, the member-attached section and the flexible clamp together for clamping the clamp ends of the outer planar members toward one another.

16. The portable garment press assembly of claim 15 wherein the first hinge member comprises outer hinge surfacing and the member-attached section comprises outer clamp surfacing, the outer hinge and clamp surfacing comprising first fastening means, the tensioning means comprising second fastening means, the first and second fastening means being cooperable for fastening the tensioning means to the first hinge member and member-attached section for retaining the outer planar members in bowed tension.

17. The portable garment press assembly of claim 11 wherein a select outer planar member comprises an aperture extending orthogonally relative to the plane of the select outer planar member, the aperture for enabling moisture to pass therethrough.

18. The portable garment press assembly of claim 11 wherein the first and second outer planar members comprise varied relative thickness, the varied relative thickness for enabling the user to selectively vary the wrinkle-removing forces.

19. The portable garment press assembly of claim 11 wherein the tensioning means are length-adjustable for enabling the user to vary the wrinkle-removing forces.

20. The portable garment press assembly of claim 11 wherein the tensioning means are looped around the hinge ends and clamp ends for interconnecting the hinge ends to the clamp ends, the looped tensioning means being loop-adjustable for enabling the user to vary the wrinkle-removing forces.

21. The portable garment press assembly of claim 11 comprising substantially identically paired first and second outer planar members with first hinge members and clamping means for joining the same, the paired first outer planar members being joined by a third hinge member at a paired-member junction intermediate the paired first and second outer planar members, the paired first outer planar members being foldable about the third hinge member for collapsing the portable garment assembly.

22. A method for mechanically pressing a garment section, the method comprising the steps of:

providing a portable garment press assembly comprising opposed resilient outer planar members interconnected at hinge ends thereof by a hinge structure, the hinge structure comprising outer hinge surfacing;

positioning a garment section upon a first of the opposed outer planar members;

positioning a second of the opposed outer planar members into contact with the garment section via the hinge structure;

clamping via clamping means the opposed outer planar members toward one another at clamp ends thereof for imparting primary wrinkle-removing forces into the garment section, the clamping means comprising outer clamp surfacing, the outer hinge and clamp surfacing comprising first fastening means; and interconnecting the hinge ends to the clamp ends with tensioning means thereby resiliently and arcuately bowing the outer planar members for imparting secondary wrinkle-removing forces into the garment section, the tensioning means comprising second fastening means, the first and second fastening means being cooperable for fastening the tensioning means to the hinge structure and clamping means for retaining the outer planar members in bowed tension.

23. The method for mechanically pressing a garment section of claim 22 wherein moisture is added to the garment section before positioning the second outer planar member into contact with the garment section.

24. The method for mechanically pressing a garment section of claim 22 wherein the portable garment press assembly comprises a resilient inner planar member, the method comprising the step of separating opposed garment sections via the inner planar member as received intermediate the opposed outer planar members.

25. The method of mechanically pressing a garment section of claim 22 wherein the outer planar members comprise varied relative thickness, the varied relative thickness for enabling the user to selectively vary the garment-compressive forces by bowing the outer planar members in a select direction as selected from two possible directions.

26. The method of mechanically pressing a garment section of claim 22 comprising the step of length-adjusting the tensioning means varying the wrinkle-removing forces.

27. The method of mechanically pressing a garment section of claim 22 comprising the step of looping the tensioning means around the hinge and clamp ends for interconnecting the same, the looped tensioning means being loop-adjustable for enabling the user to vary the wrinkle-removing forces.

28. A method for mechanically pressing a garment section, the method comprising the steps of:

positioning a garment section upon a first outer planar member;

positioning a second outer planar member into contact with the positioned garment section; and resiliently and arcuately bowing the outer planar members for imparting wrinkle-removing forces into the garment section.

29. The method for mechanically pressing a garment section of claim 28 comprising the step of interconnecting opposed ends of the outer planar members with tensioning means thereby retaining the outer planar members in bowed relation.

30. The method for mechanically pressing a garment section of claim 29 comprising the step of adjusting the tensioning means for selectively varying the wrinkle-removing forces.

31. The method of mechanically pressing a garment section of claim 29 wherein the outer planar members comprise varied relative thickness, the varied relative thickness for enabling the user to selectively vary the wrinkle-removing forces by bowing the outer planar members in a select direction as selected from two possible directions.

* * * * *